US007484817B2

(12) United States Patent
Hoffman et al.

(10) Patent No.: US 7,484,817 B2
(45) **Date of Patent: *Feb. 3, 2009**

(54) INTERLOCK MECHANISM FOR LATERAL FILE CABINETS

(75) Inventors: Keith A. Hoffman, Hudsonville, MI (US); Sharon M. Carson, Zeeland, MI (US)

(73) Assignee: Knape & Vogt Manufacturing Co., Grand Rapids, MI (US)

( * ) Notice: Subject to any disclaimer, the term of this patent is extended or adjusted under 35 U.S.C. 154(b) by 41 days.

This patent is subject to a terminal disclaimer.

(21) Appl. No.: 10/536,671

(22) PCT Filed: Nov. 26, 2003

(86) PCT No.: PCT/US03/38001

§ 371 (c)(1),
(2), (4) Date: Dec. 13, 2005

(87) PCT Pub. No.: WO2004/049864

PCT Pub. Date: Jun. 17, 2004

(65) Prior Publication Data

US 2006/0267461 A1 Nov. 30, 2006

(51) Int. Cl.
*E05C 7/06* (2006.01)

(52) U.S. Cl. ..... 312/219; 312/221

(58) Field of Classification Search ..... 312/215–219, 312/221, 222; 292/125, 225

See application file for complete search history.

(56) References Cited

U.S. PATENT DOCUMENTS 1,720,554 A * 7/1929 Johnson ..... 292/94
3,941,441 A 3/1976 Scheerhorn
4,239,309 A 12/1980 De Fouw et al.
4,240,685 A 12/1980 Terlecki
4,246,769 A 1/1981 McLaughlin
4,355,851 A 10/1982 Slusser (Continued)

FOREIGN PATENT DOCUMENTS

DE 4416768 * 11/1994

OTHER PUBLICATIONS 5-page Knape & Vogt Interlok brochure describing an interlock system that pre-dates the filing of the present application.

(Continued)

*Primary Examiner*—Janet M Wilkens
(74) *Attorney, Agent, or Firm*—Cook Alex Ltd.

(57) ABSTRACT

Interlocks for file cabinets and the like which generally prevent more than one drawer from being opened at a given time. The interlocks include a cable which is changeable from a slack condition to a taut condition. In the taut condition, the interlocks prevent the associated drawer from being opened. In the slack condition, the interlock allows the associated drawer to be opened. The interlocks may be used in conjunction with a lock that selectively changes the tension in the cable from a slack condition to a taut condition and vise versa. The interlocks may be constructed to exert a tension on a cable that is independent of the pulling force exerted on a locked drawer. Alternatively, the interlocks may be constructed to exert a force on the cable that is a small fraction of the pulling force exerted on a locked drawer.

21 Claims, 29 Drawing Sheets

U.S. PATENT DOCUMENTS 4,429,930 A 2/1984 Blouin
4,637,667 A 1/1987 Reid et al.
4,711,505 A 12/1987 Lakso
4,732,434 A 3/1988 Hartrum
4,737,039 A 4/1988 Sekerich
4,820,002 A 4/1989 Lechner
4,889,396 A 12/1989 Mitchell et al.
4,955,672 A 9/1990 Pham
4,957,334 A 9/1990 Lakso
4,960,309 A 10/1990 Scheerhorn
4,966,423 A 10/1990 Higuera
5,050,942 A 9/1991 Frederick et al.
5,056,876 A 10/1991 Scheerhorn
5,056,877 A 10/1991 Westwinkel
5,062,678 A 11/1991 Westwinkel
5,176,436 A * 1/1993 Mitchell ..... 312/221
5,184,887 A 2/1993 O'Keefe et al.
5,199,774 A 4/1993 Hedinger et al.
5,225,825 A 7/1993 Warren
5,303,994 A 4/1994 Elsholz
5,333,949 A 8/1994 McGregor
5,335,986 A 8/1994 Hartrum et al.
5,352,030 A 10/1994 Derle et al.
5,389,919 A 2/1995 Warren et al.
5,427,445 A * 6/1995 Mitchell ..... 312/221
5,466,060 A 11/1995 Hoffman
5,472,272 A 12/1995 Hoffman
5,507,571 A 4/1996 Hoffman
5,533,798 A 7/1996 Feldpausch et al.
5,586,817 A 12/1996 Hubbard et al.
5,671,985 A 9/1997 Grieser
5,685,622 A 11/1997 Laakso
5,695,265 A 12/1997 Hoffman
5,709,442 A 1/1998 Feldpausch et al.
5,805,074 A 9/1998 Warren et al.
5,823,643 A 10/1998 Feldpausch et al.
5,829,859 A 11/1998 Cram
5,865,404 A 2/1999 Hesley
5,868,479 A 2/1999 Hoffman
5,931,548 A 8/1999 Bischoff
5,988,778 A 11/1999 Lammens
5,997,114 A 12/1999 Bischoff
6,033,047 A 3/2000 Hoffman
6,082,839 A 7/2000 Chiku
6,186,606 B1 2/2001 Krei
6,238,024 B1 5/2001 Sawatzky
6,296,332 B1 10/2001 Lammens
6,779,855 B2 * 8/2004 Hoffman ..... 312/219
7,063,398 B2 * 6/2006 Hoffman ..... 312/219
7,293,845 B2 * 11/2007 Hoffman ..... 312/219
2002/0014817 A1 2/2002 Lammens
2002/0093274 A1 7/2002 Jackson

OTHER PUBLICATIONS 1-page Knape & Vogt Interlok brochure (double-sided) describing an interlock system dated 1997.

* cited by examiner

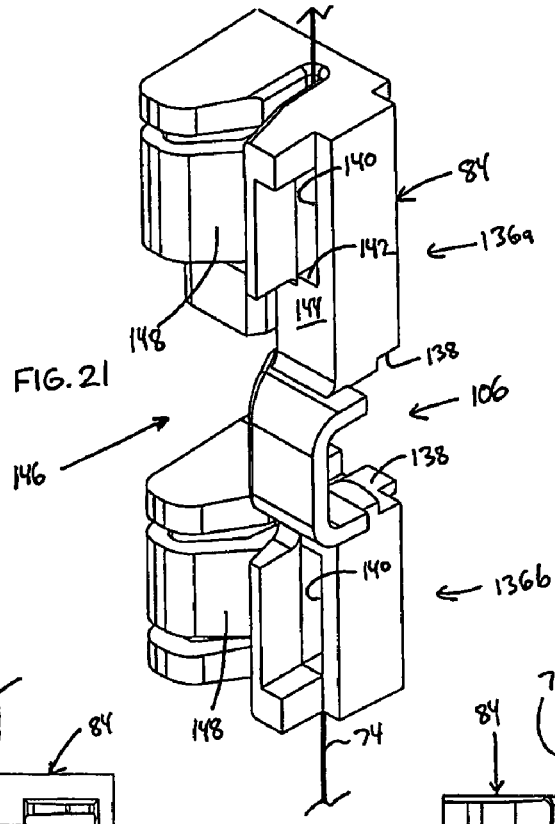
FIG. 21
FIG. 22
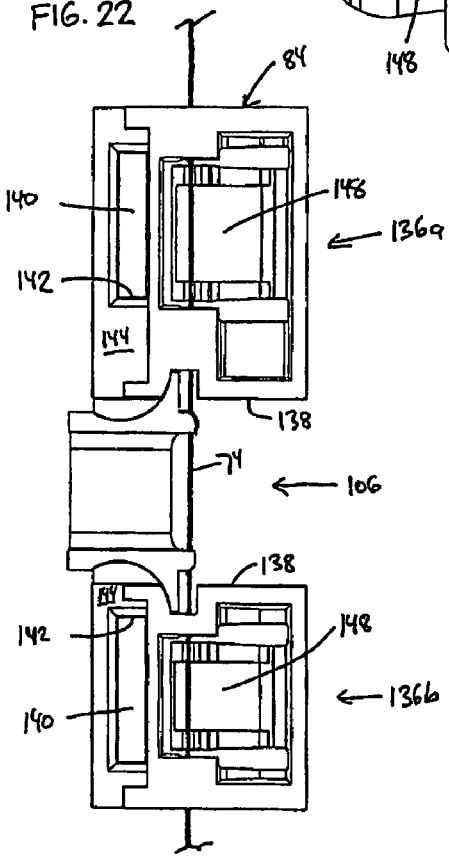
FIG. 23
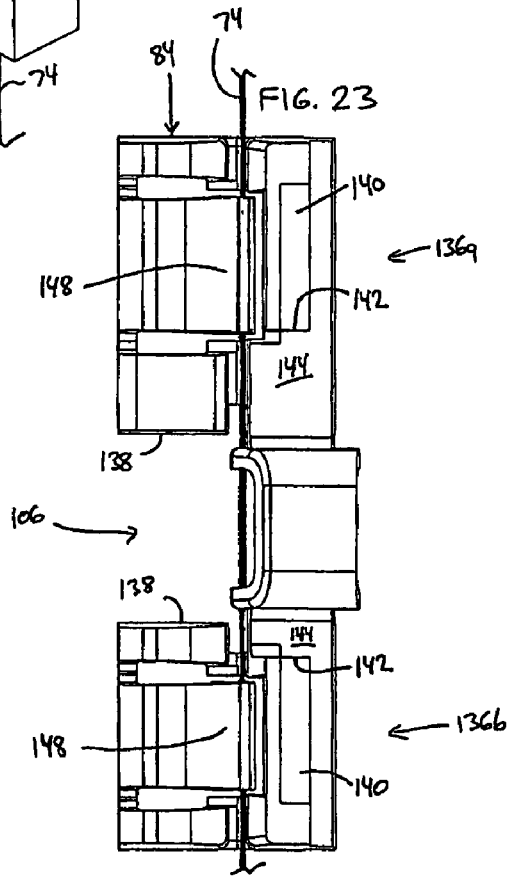

72'
90'
190
154
164
156
86'
84'
168
158
104'
82'
70'

72'
90'
154
164
156
86'
84'
168
200
104'
82'
70'

72'
90'
156
154
164
190
160
84'
158
168
86'
104'
82'
70'

72'
90'
190
154
164
156
86'
84'
182
160
200
104'
158
82'
70'

INTERLOCK MECHANISM FOR LATERAL FILE CABINETS

BACKGROUND OF THE INVENTION

The present invention relates to filing cabinets, and more particularly to mechanisms adapted to prevent one or more of the drawers in the filing cabinet from being opened. It has been known in the past to include interlock mechanisms on filing cabinets that prevent more than one drawer in the cabinet from being opened at a single time. These interlock mechanisms are generally provided as safety features that are intended to prevent the filing cabinet from accidentally falling over, a condition that may be more likely to occur when more than one drawer in the cabinet is open. By being able to open only a single drawer at a given time, the ability to change the weight distribution of the cabinet and its contents is reduced, thereby diminishing the likelihood that the cabinet will fall over.

In addition to such interlocks, past filing cabinets have also included locks that prevent any drawers from being opened when the lock is moved to a locking position. These locks are provided to address security issues, rather than safety issues. These locks override the interlocking system so that if the lock is activated, no drawers may be opened at all. If the lock is not activated, the interlock system functions to prevent more than one drawer from being opened at the same time. Oftentimes the system that locks all of the drawers and the interlock system that locks all but one of the drawers are at least partially combined. The combination of the locking system with the interlocking system can provide cost reductions by utilizing common parts.

Past locking and interlocking mechanisms, however, have suffered from a number of disadvantages. One disadvantage is the difficulty of changing the drawer configurations within a cabinet. Many filing cabinets are designed to allow different numbers of drawers to be housed within the cabinet. For example, in the cabinet depicted in FIG. 1, there are three drawers in the cabinet. For some cabinets, it would be possible to replace these three drawers with another number of drawers having the same total height as the three original drawers. This reconfiguration of the drawers is accomplished by removing the drawer slides on each side of the drawer and either repositioning the drawer slides at the newly desired heights, or installing new drawer slides at the new heights. Many drawer slides include bayonet features that allow the drawer slides to be easily removed and repositioned within the cabinet.

In the past, such reconfiguring of the drawers in a cabinet has been a difficult task because the interlocking and/or locking system for the drawers could not easily be adjusted to match the newly configured filing cabinet. For example, U.S. Pat. No. 6,238,024 issued to Sawatzky discloses an interlock system that utilizes a series of rigid rods that are vertically positioned between each drawer in the cabinet. The height of these rods must be chosen to match the vertical spacing between each of the drawers in the system. If the cabinet is to be reconfigured, then new rods will have to be installed that match the height of the new drawers being installed in the cabinet. Not only does this add additional cost to the process of reconfiguring the cabinet, it complicates the reconfiguring process by requiring new parts of precise dimensions to be ordered. Finding these precisely dimensioned parts may involve extensive searching and/or measuring, especially where the manufacturer of the rods is not the same entity that produced the new drawers being installed, or the manufacturer of the rods has ceased producing the parts, or has gone out of business.

Another difficulty with systems like that disclosed in the Sawatzky patent is the precise manufacturing that may be required to create these rigid rods. These interlock systems only work if the rods have heights that fall within a certain tolerance range. This tolerance range, however, decreases as more interlocks are installed in a given cabinet. In other words, the tolerance of the heights of these rods is additive. In order to function properly, a cabinet with ten drawers will therefore require smaller tolerances in the rods than a two drawer cabinet. In order to create rods that can be universally used on different cabinets, it is therefore necessary to manufacture the rods within the tight tolerances required by the cabinet having the greatest expected number of drawers. These tight tolerances tend to increase the cost of the manufacturing process.

Another difficulty with past interlock and lock systems for file cabinets has been the expense involved in creating a locking system that will withstand high forces exerted on the drawers. The Business and Institutional Furniture Manufacturer's Association (BIFMA) recommends that lock systems for file cabinets be able to withstand 50 pounds of pressure on a drawer. Thus, if a file cabinet does not exceed this standard, thieves can gain access to the contents of a lock drawer by pulling the drawer outwardly with more than fifty pounds of force. Many users of file cabinets, however, desire their locking system to be able to withstand much greater forces than this before failure. Increasing the durability of the locking system often adds undesired expense to the cost of building the system.

A number of prior art interlock systems have used cables or straps as part of the interlocking system. Such systems, however, have suffered from other disadvantages. For example, U.S. Pat. No. 5,199,774 issued to Hedinger et al. discloses an interlock and lock system that uses a cable. The slack in the cable is decreased when a drawer is opened. The amount of slack of the cable is carefully chosen during the installation of the drawer lock so that there is just enough slack in the system to allow only one drawer to be opened at a time. The interlock on whatever drawer is opened takes up this available slack in the cable, which prevents other drawers from being opened at the same time. A similar system is disclosed in U.S. Pat. No. 5,062,678 issued to Westwinkel. This system uses a strap instead of a cable. Both systems suffer from the fact that excessive amounts of force may be easily transferred to either the cable or the strap. In other words, the cable or the strap itself are what resist the pulling force that a person might exert on a closed drawer when either the lock is activated, or another drawer is opened. The tensile strength of the cable or strap therefore determines how much force must be exerted to overcome the interlock or lock. In fact, in the interlock of Westwinkel, the system appears to be constructed so that the pulling force exerted by a person on a locked drawer will be amplified before being applied to the strap. The strap must therefore have a greater tensile strength than the highest rated pulling force that the lock or interlock system can resist. Increasing the strength of the cables or straps typically tends to increase their cost, which is desirably avoided.

In light of the foregoing, the desirability of an interlock and lock system that overcomes these and other disadvantages can be seen.

SUMMARY OF THE INVENTION

Accordingly, the present invention provides an interlock and lock that reduces the aforementioned difficulties, as well as other difficulties. The interlock and lock of the present invention allow relatively low-tensile strength cables or flexible members to be used in systems which provide high resistance to theft and breakdown. The system of the present invention further allows changes to cabinet configurations to be easily implemented with little or no additional work required to integrate the new cabinet configuration into the interlock or lock system. The present invention provides a simple construction for locks and interlocks that can be easily manufactured without excessively restrictive tolerances, and which can be easily installed in cabinets.

According to one aspect of the present invention, an interlock for a cabinet drawer is provided. The drawer is movable in the cabinet is a first direction toward an open position and in a second, opposite direction toward a closed position. The interlock includes an elongated, flexible member, a rotatable lever, an engagement member, and a biasing member. The lever is adapted to alter the amount of slack in the elongated, flexible member. The lever is rotatable between a first position and a second position. The first position creates a low amount of slack in the elongated, flexible member, and the second position allows a high amount of slack to be present in the elongated, flexible member. The engagement member is attached to the drawer and positioned to cause the rotatable lever to rotate toward the first position when the drawer is initially moved from the closed position in the first direction. The biasing member is positioned adjacent the lever and adapted exert a force that tends to prevent the lever from rotating from the first position to the second position until the drawer is moved in the second direction to the closed position.

According to another aspect of the present invention, an interlock is provided that includes a cable, a slack take-up mechanism, a cam, and a biasing member. The slack take-up mechanism is engage able with the cable and movable between a high-tension position and a low-tension position. The high-tension position creates a greater amount of tension than the low-tension position in the cable. The cam is operatively coupled to the slack take-up mechanism and to the drawer. The cam is adapted to switch the slack take-up mechanism from the low-tension position to the high-tension position when the drawer is moved in the first direction toward the open position. The biasing member is adapted to exert a force against the take-up mechanism that urges the slack take-up mechanism toward the high-tension position. The force of the biasing member has a magnitude that is independent of the magnitude of the force exerted on the drawer in the first direction.

According to still another aspect of the present invention, an interlock is provided. The interlock includes a cable, a rotatable lever, an engagement member, and a retainer. The lever is adapted to change the cable between high and low slack conditions. The engagement member is attached to the drawer and positioned to cause the lever to rotate to a first position that changes the cable to a low slack condition when the drawer is initially moved in the first direction from the closed position. The engagement member is also positioned such that a first force exerted on the drawer in the first direction is translated by the lever to a second force on the cable, which is less than the first force. The retainer is adapted to retain the rotatable lever in the first position while the drawer is moved to the open position.

According to still another aspect of the present invention, a locking and interlocking system for a cabinet is provided. The system includes a lock, a first cable, a second cable, a first interlock, and a second interlock. The first cable extends between at least a first and second drawer. The first cable is changeable from a high slack to a low slack condition. The second cable extends between the lock and the first drawer. The lock is adapted to change the second cable from a high slack to a low slack condition. The first interlock is in communication with the first and second cables and adapted to change both said first and said second cables from the high slack to the low slack condition whenever the first drawer is opened. The first interlock is further adapted to prevent the first drawer from opening whenever the first or second cables are in the low slack condition. The second interlock is in communication with the first cable and adapted to change the first cable from the high slack to the low slack condition whenever the second drawer is opened. The second interlock is further adapted to prevent the second drawer from opening whenever the first cable is in the low slack condition.

According to yet another aspect of the present invention, a cabinet is provided that includes at least one drawer movable within the cabinet in a first direction toward an open position and in a second, opposite direction toward a closed position. The cabinet further includes a frame adapted to support the drawer, an elongated, flexible member, an interlock, and a slack take up mechanism. The elongated, flexible member is positioned within the cabinet and changeable between a lower slack condition and a higher slack condition. The interlock is positioned within the frame and in operative engagement with the elongated, flexible member. The interlock is adapted to prevent the drawer from moving to the open position when the elongated, flexible member is in the lower slack condition and to allow the drawer to move to the open position when the elongated, flexible member is in the hither slack condition. The slack take up mechanism is adapted to change the elongated, flexible member from the high slack condition to the lower slack condition when the drawer is moved from the closed position to the open position. The slack take up mechanism is further adapted to translate a first force exerted on the drawer in the first direction to a second force exerted on the elongated, flexible member which is less than the first force.

According to still other aspects of the present invention, the interlock may be in communication with a lock that is adapted to selectively alter the condition of the cable. The interlocks may be secured to drawer slides that are removable from the cabinet. A cable guide may be included as part of the interlock to snap fittingly receive the cable and retain it in engagement with the interlock.

The various aspects of the present invention provides an interlock and lock system that is versatile, resistant to high forces, and easily installed. These and other benefits of the present invention will be apparent to one skilled in the art in light of the following written description when read in conjunction with the accompanying drawings. The interlock may be in communication with a lock that is adapted to selectively alter the tension in the cable.

The interlocks may be secured to drawer slides that are removable from the cabinet. A cable guide may be included as part of the interlock to snap-fittingly receive the cable and retain it in engagement with the interlock.

The various aspect of the present invention provides an interlock and lock system that is versatile, resistant to high forces, and easily installed. These and other benefits of the present invention will be apparent to one skilled in the art in light of the following written description when read in conjunction with the accompanying drawings.

BRIEF DESCRIPTION OF THE DRAWINGS

FIG. 21 is a perspective view of a cable guide of the interlock of FIG. 3;

FIG. 22 is a bottom view of the cable guide of FIG. 2E;

FIG. 23 is a plan view of the cable guide of FIG. 21;

DETAILED DESCRIPTION OF THE INVENTION

Figure 1:
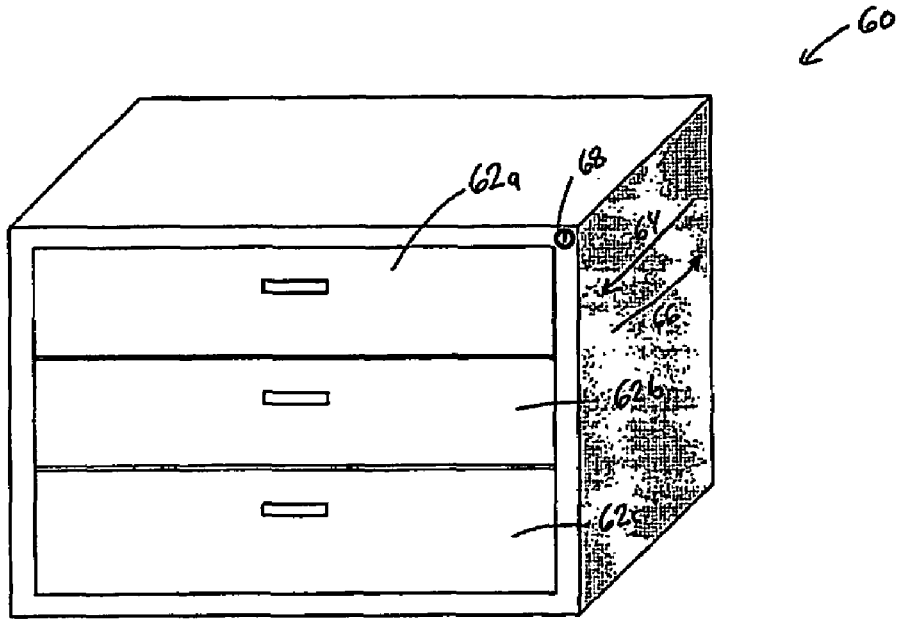
FIG. 1 is a perspective view of a cabinet with three drawers in a closed position.
Figure 2:
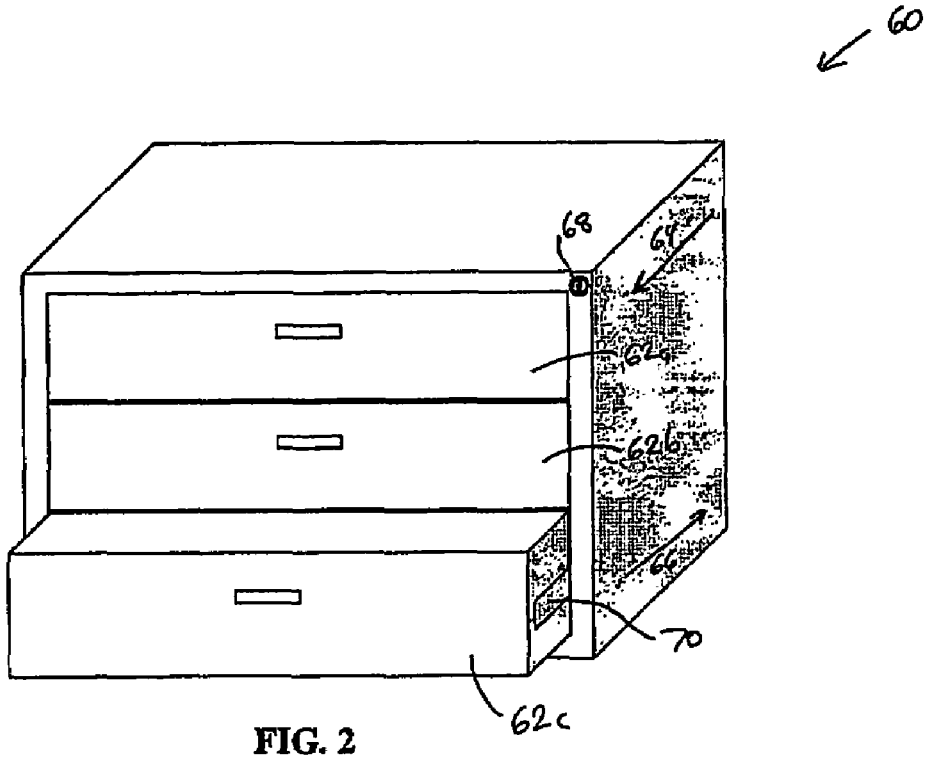
FIG. 2 is a perspective view of the cabinet of FIG. 1 illustrated with one drawer moved to an open position.

The present invention will now be described with reference to the accompanying drawings wherein the reference numerals in the following written description correspond to like numbered elements in the several drawings. The present invention relates to locks and interlocks that may be used with file cabinets, such as the file cabinet 60 depicted in FIGS. 1 and 2. File cabinet 60 includes three drawers 62*a-c* that are essentially stacked on top of each other in file cabinet 60. Each drawer can be pulled in a first direction 64 toward an open position. The lower most drawer 62*c* in FIG. 2 is illustrated in the open position. When it is time to close this drawer, it can be pushed in a second direction 66 back to its closed position. The interlocking system of the present invention prevents more than one drawer from being opened at a single time. While only three drawers are illustrated in file cabinet 60, the present invention is applicable to cabinets having any number of drawers. The present invention also includes a locking system that overrides the interlocking system. That is, when the locking system is activated, no drawers can be opened at any time. When the locking system is deactivated, the interlocking system is activated and prevents more than one drawer from being opened at a single time. The locking system may be activated by inserting a key into a keyhole 68 positioned at any suitable location on the file cabinet. The locking and interlocking system are highly integrated so that many of the components of the interlocking system are also used in the locking system.

The interlocks of the present invention may be advantageously combined or attached to the drawer slides in which drawers 62 slidingly move between their open and closed position. An example of one of these drawer slides 70 is depicted in FIG. 2 for the lowermost drawer 62*c*. Each drawer 62 includes two drawer slides 70, one positioned on one side of the drawer and another positioned on the opposite side of the drawer. While the interlocks of the present invention can be placed at other locations besides on drawer slide 70, the attachment of the interlocks to the drawer slide 70 allows the interlocks to be simultaneously removed and repositioned when the drawer slides 70 are removed and repositioned. This greatly facilitates the reconfiguration of a file cabinet 60 with differently sized drawers 62.

Figure 3:
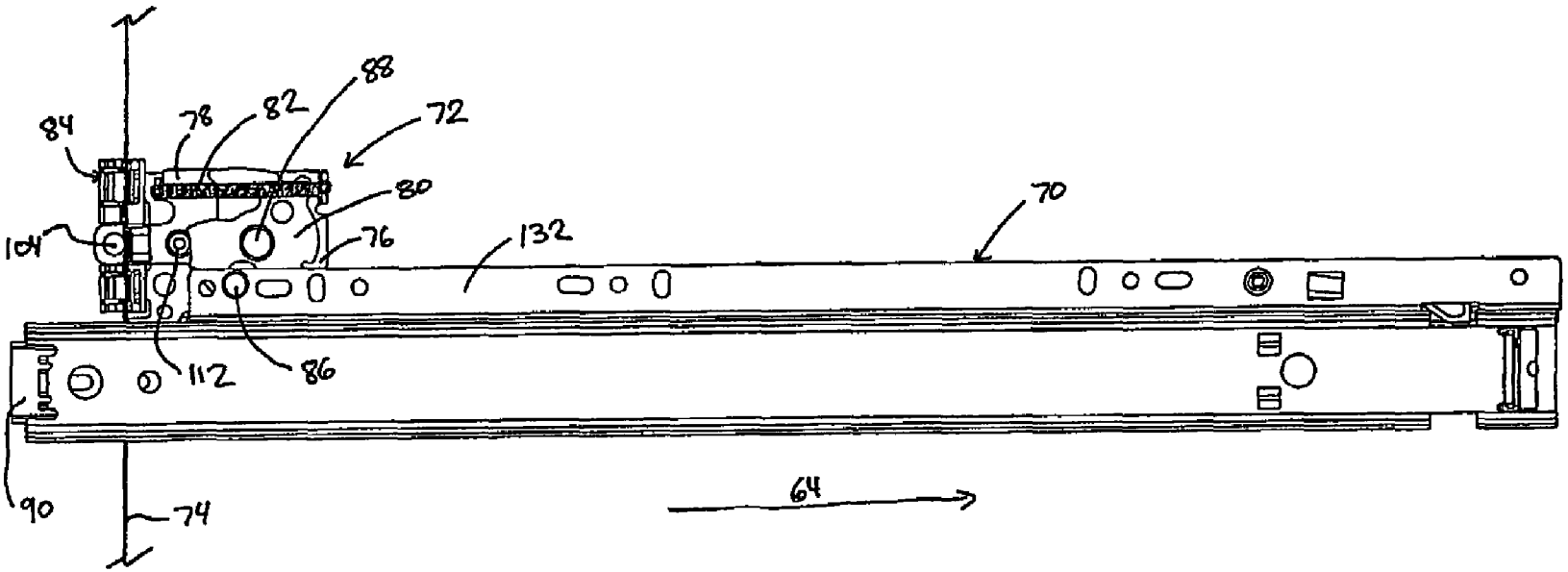
FIG. 3 is a side, elevational view of an interlock and drawer slide according to a first embodiment of the present invention.

An interlock 72 according to a first embodiment of the present invention is depicted in FIG. 3, Interlock 72 is attached to a drawer slide 70. Interlock 72 is operatively coupled to a cable 74 that runs vertically inside of cabinet 60. In general, interlock 72 operates according to the tension in cable 74. Specifically, cable 74 has two different basic levels of tension. When no drawers are opened and the lock is not activated, cable 74 has a first amount of tension in it. When a single drawer is opened, interlock 72 takes up the slack in cable 74 and creates a second level of tension in cable 74. With the second level of tension, the slack in cable 74 is reduced to such a small level that no other drawers in the cabinet 60 can be opened. When the open drawer is closed, the slack in the cable 74 returns and any other single drawer may thereafter be opened. If a lock is included with the cabinet 60, the lock is adapted to alter the tension in cable 74. When in the locked position, the lock removes the slack in cable 74. When in the unlocked condition, the lock provides cable 74 with sufficient slack so that a single drawer may be opened. Interlocks 72 are thus designed to only allow their associated drawer to be opened when cable 74 has sufficient slack. Further, they are designed to remove the slack in cable 74, if their associated drawer is opened. The detailed construction of interlock 72, as well as how they accomplish the aforementioned functions, will now be described.

Figure 4:
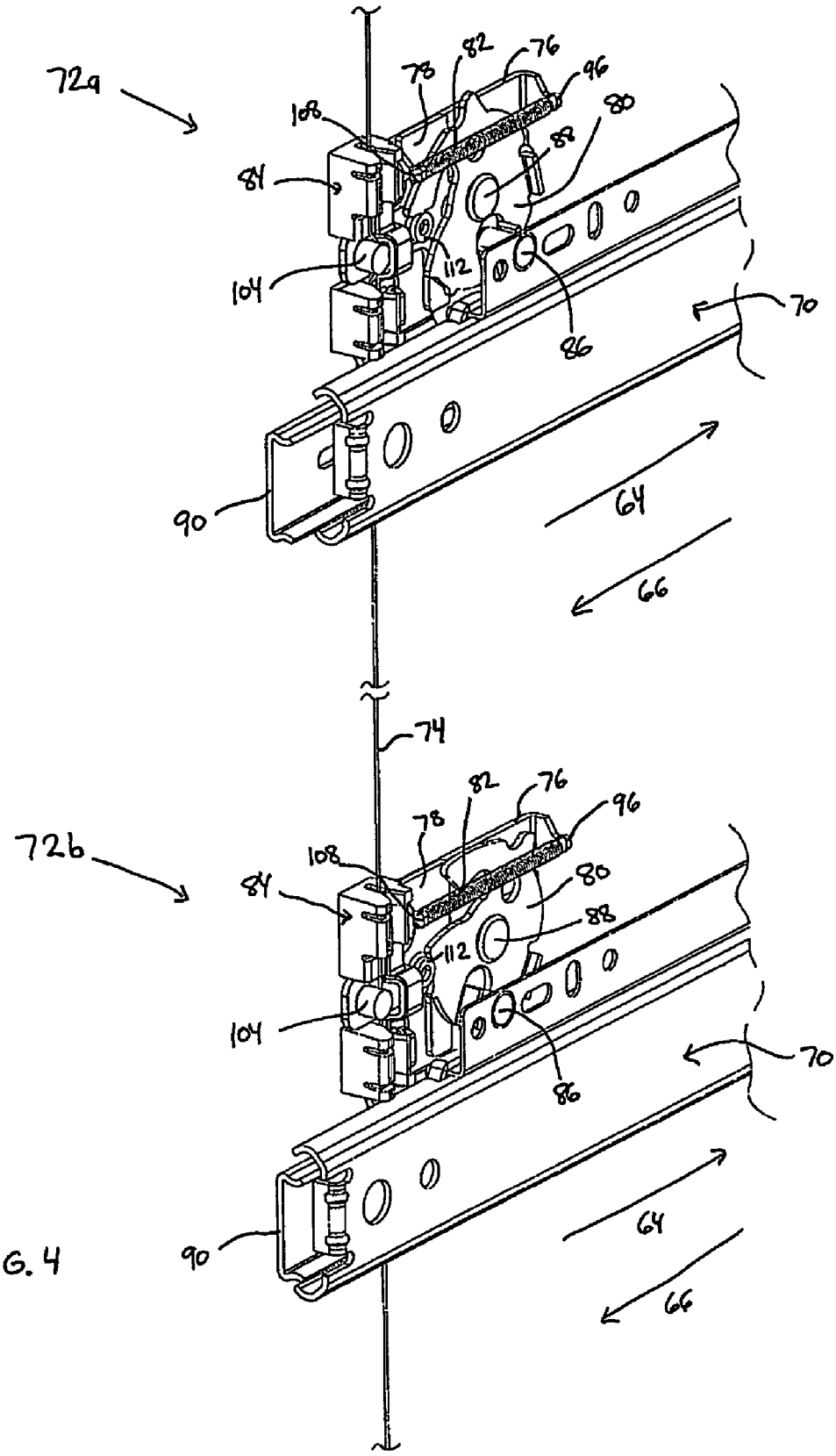
FIG. 4 is a perspective view of a pair of interlocks according to the first embodiment of the present invention.
Figure 5:
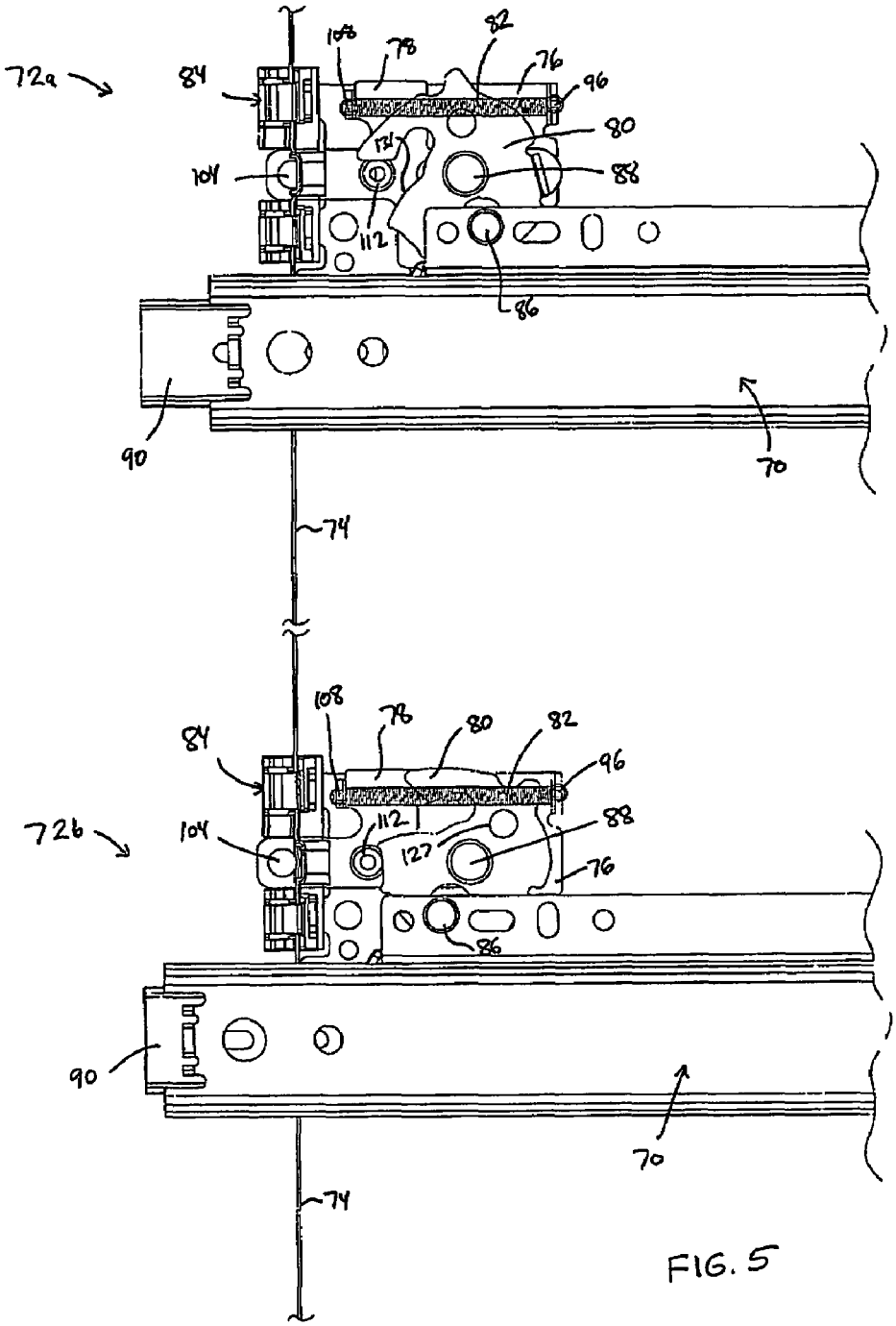
FIG. 5 is a side, elevational view of the pair of interlocks of FIG. 4.
Figure 6:
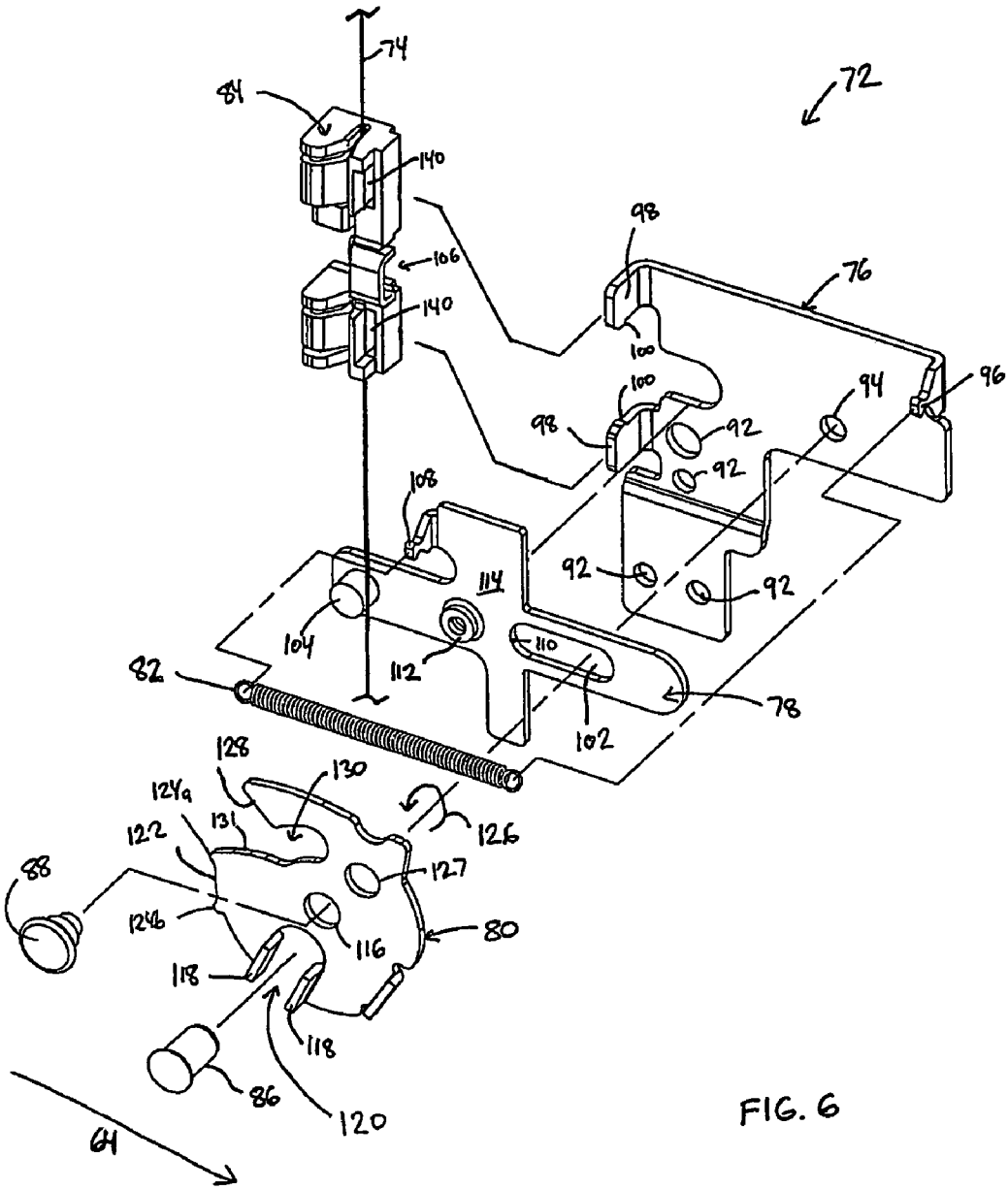
FIG. 6 is a perspective, exploded view of the interlock of FIG. 3.

As illustrated in FIG. 6, interlock 72 generally includes an attachment plate 76, a sliding plate 78, a rotatable cam or lever 80, a spring 82, a cable guide 84, an engagement member 86, and a rivet 88. Attachment plate 76 is a stationary part that secures interlock 72 to drawer slide 70. Specifically, attachment plate 76 is secured to a stationary portion 90 of drawer slide 70. Stationary portion 90 is illustrated in FIGS. 4 and 5. Stationary portion 90 is, in turn, secured to appropriate attachment structures within file cabinet 60. Those attachment structures may allow drawer slide 70 to be easily removed and repositioned inside of cabinet 60. Attachment plate 76 may be secured to stationary portion 90 of drawer slide 70 in any suitable fashion, such as by welding, or the use of fasteners.

Attachment plate 76 includes a plurality of fastener holes 92 which may be used to receive rivets, screws, or other fasteners to secure attachment plate 76 to stationary portion 90 of drawer slide 70. Attachment plate 76 is depicted in detail in FIGS. 6 and 8-10. Attachment plate 76 further includes a rivet hole 94 which receives rivet 88. Rivet 88 secures cam 80 to attachment plate 76 in a rotatable fashion. Stated alternatively, cam 80 is attached to attachment plate 76 in such a manner that it can rotate about the axis generally defined by rivet 88. Attachment plate 76 further includes a spring attachment nub 96 to which one end of spring 82 is attached. Attachment plate 76 also includes a pair of bent flanges 98. Bent flanges 98 are received inside of cable guide 84 and used to secure cable guide 84 to attachment plate 76. Each flange 98 includes a shoulder 100 that retains cable guide 84 on attachment plate 76 after they have been attached, as will be explained in more detail below.

Sliding plate 78, which is depicted in detail in FIGS. 6 and 11-13, is positioned between attachment plate 76 and cam 80. Sliding plate 78 slides linearly in a direction parallel to first and second directions 64 and 66. When a drawer 62 is initially opened, sliding plate 78 slides linearly in first direction 64. As the drawer fully closes, sliding plate 78 slides back to its original position in second direction 66. Sliding plate 78 includes an elongated aperture 102 that receives rivet 88. Because elongated aperture 102 has a length much greater than the diameter of rivet 88, sliding plate 78 can slide along rivet 88 while still being supported by rivet 88. Sliding plate 78 includes an engagement lug 104 positioned at an end generally opposite to elongated aperture 102. Engagement lug 104 engages cable 74 generally along its side that faces toward elongated aperture 102. The side of sliding plate 78 adjacent engagement lug 104 is supported in a channel 106 defined by cable guide 84. When sliding plate 78 slides in first direction 64, engagement lug 104, which is in engagement with cable 74, decreases the slack in cable 74. Thus, when a drawer is open, sliding plate 78 and engagement lug 104 remove the slack from cable 74. This will be described in more detail below.

Sliding plate 78 further includes a spring attachment nub 108. Spring attachment nub 108 is used to attach the other end of spring 82 to sliding plate 78. When spring 82 is connected between attachment nubs 108 and 96, spring 82 exerts a force that tends to urge attachment nubs 96 and 108 toward each other in a direction generally parallel to first direction 64. The movement of sliding plate 78 toward spring attachment nub 96 of attachment plate 76 is limited by an interior surface 110 of elongated aperture 102. When interior surface 110 contacts rivet 88, sliding plate 78 can no hanger be moved any further in first direction 64. As will be described in more detail herein, spring 82 exerts the tensioning force on cable 74, by way of engagement lug 104 when a drawer is opened. Depending on the physical construction of interlock 72, as well as the type of cable 74 chosen, spring 82 may be desirably chosen to exert a force against sliding plate 78 of one to two pounds in a first direction 64 when a drawer is open. Other amounts of force can also be used within the scope of the present invention. The amount of this force should be sufficient to retain cable 74 in a taut condition whenever any other drawers are attempted to be opened.

Sliding plate 78 further includes an embossment 112 on a side 114 that faces cam 80. Embossment 112 is positioned between elongated aperture 102 and engagement lug 104. Embossment 112 interacts with cam 80 in a manner that will be described in more detail herein. In general, cam 80 acts as a switch for moving sliding plate 78 between a tensioning position, in which tension is exerted on cable 74, and a non-tensioning position, in which no tension, or very little tension, is exerted on cable 74. This switching occurs when the drawer associated with interlock 72 is opened or closed. This switching utilized embossment 112, as explained more below.

Cam 80, which is depicted in more detail in FIGS. 6 and 14-16, includes a central aperture 116 which receives rivet 88. As mentioned previously, cam 88 is rotatable about rivet 88. Cam 80 includes a pair of spaced flanges 118 that define a channel 120 therebetween. Channel 120 selectively receives engagement member 86. Engagement member 86 is attached to the drawer 62 such that it will move linearly in first direction 64 when the drawer is open, and in second direction 66 when the drawer is closed. Cam 80 translates this linear motion into a rotational motion. Cam 80 includes a first surface 122 that engages embossment 112 whenever the associated drawer is fully closed. Raised shoulders 124*a* and *b* are defined adjacent each end of first surface 122. Raised shoulders 124*a* and *b* tend to maintain embossment 112 on first surface 112 and thereby resist inadvertent rotation of cam 80.

From the position illustrated in FIG. 6, cam 80 is generally rotatable in a direction 126. This rotation in direction 126 is activated by the associated drawer being pulled toward the open position. When the drawer is so pulled, engagement member 86 begins to move in first direction 64. Because engagement member 86 is housed within channel 120, this movement in first direction 64 causes cam 80 to begin to rotate in direction 126. As this rotation continues, raised shoulder 124*a* of cam 80 comes into contact with embossment 112. In order for the rotation of cam 80 to continue, sliding plate 78 must be pushed in second direction 66 a small amount in order to provide clearance for embossment 112 to overcome shoulder 124*a*. Shoulder 124*a* is an optional feature that, if provided, helps to ensure that the drawer stays shut after it is closed. If the drawer is shut hard enough to create a rebounding force that would otherwise cause the drawer to open backup again, at least partially, shoulder 124*a* provides sufficient resistance to prevent this rebounding force to open the drawer. Shoulder 124*a* thus serves to maintain a drawer in the closed position until a user exerts sufficient force on a drawer to move embossment 112 past shoulder 124*a*.

Figure 7:
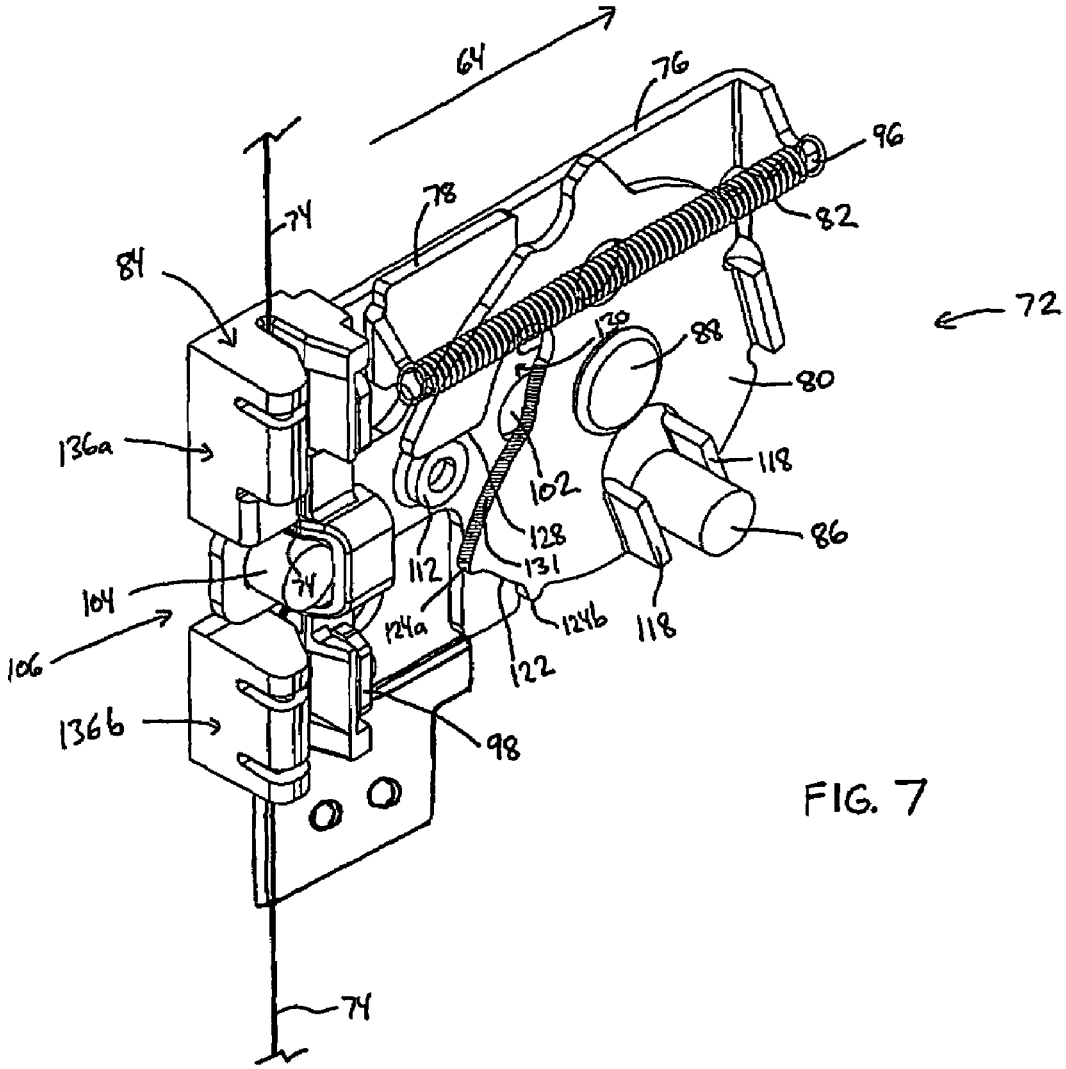
FIG. 7 is a perspective view of the interlock of FIG. 3 illustrated without a drawer slide attached.
Figure 8:
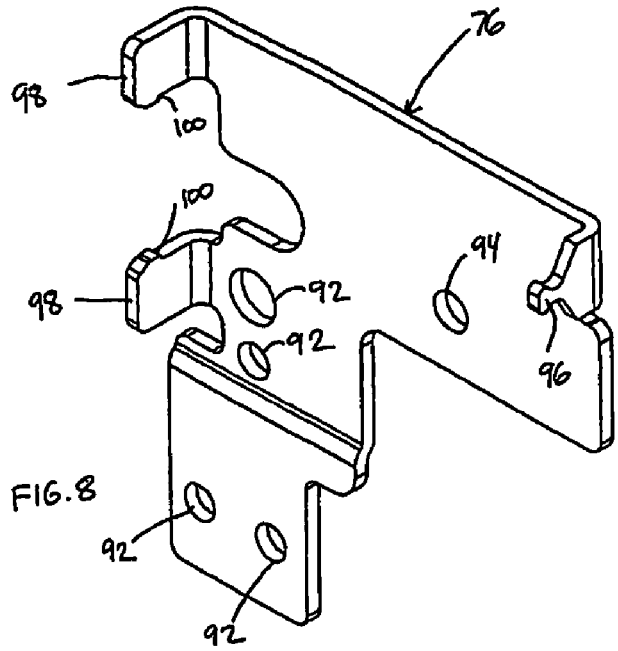
FIG. 8 is a perspective view of an attachment plate of the interlock of FIG. 3.
Figure 9:
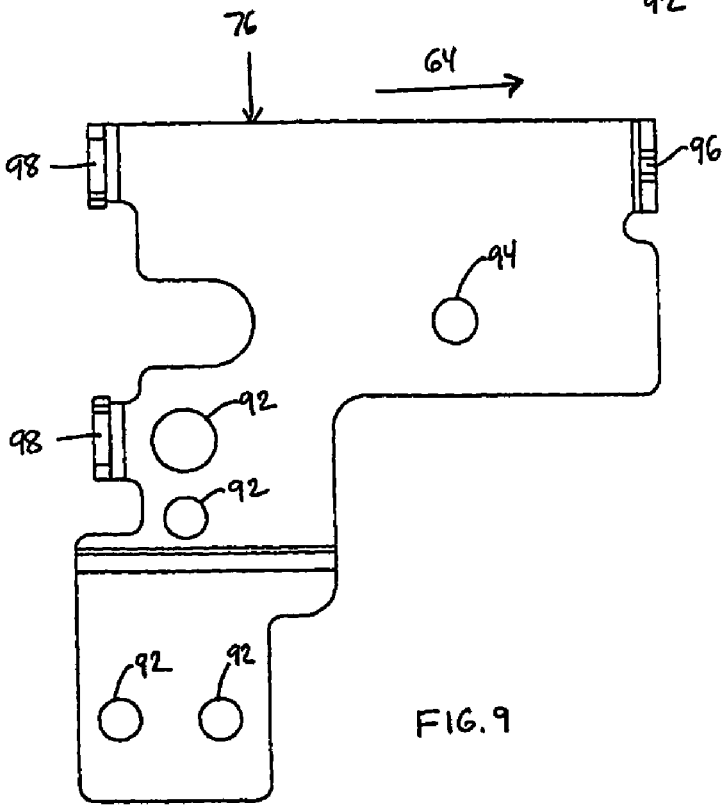
FIG. 9 is a plan view the attachment plate of FIG. 8.
Figure 10:
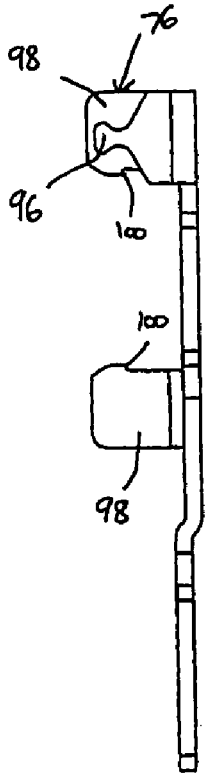
FIG. 10 is a side, elevational view of the attachment plate of FIG. 8.
Figure 11:
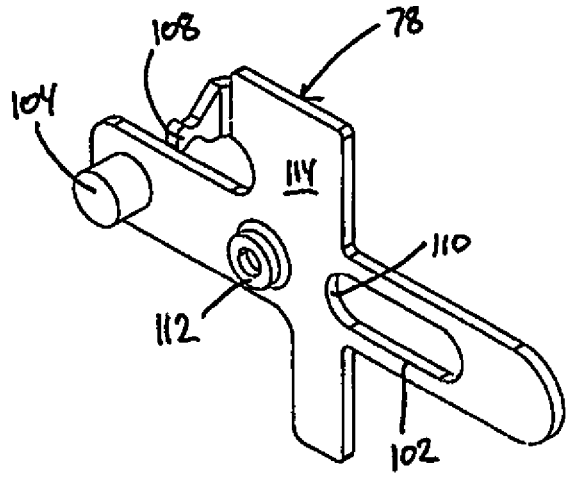
FIG. 11 is a perspective view of a sliding plate of the interlock of FIG. 3.
Figure 12:
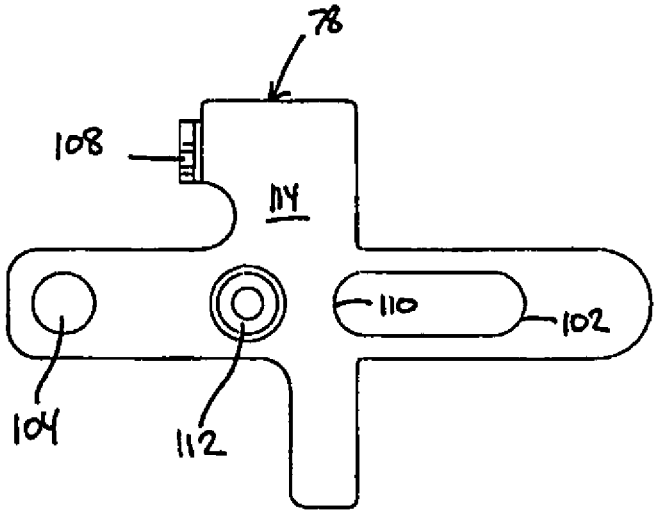
FIG. 12 is a plan view of the sliding plate of FIG. 11.
Figure 13:
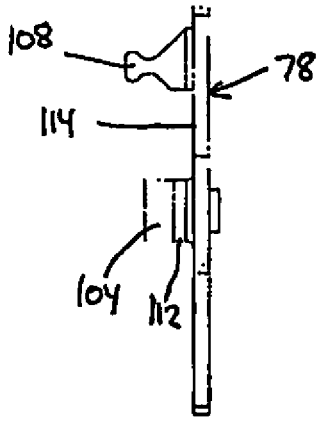
FIG. 13 is a side, elevational view of the sliding plate of FIG. 11.

After embossment 112 has overcome raised shoulder 124*a*, the force of spring 82 tends to pull sliding plate 78 in first direction 64. If cable 74 is in a taut condition, however, sliding plate 78 will not be able to move in first direction 64 because engagement lug 104 will be prevented from moving in first direction 64 by the taut cable. If the cable is taut, further rotation of cam 80 in direction 126 will only be able to continue until a stop surface 128 on cam 80 abuts against embossment 112. This condition is illustrated in FIG. 7. Once stop surface 128 comes into contact with embossment 112, further rotation of cam 80 indirection 126 is impossible. The degree of rotation of cam 80 when embossment 112 is in engagement with stop surface 128 is insufficient to allow engagement member 86 to exit from channel 120. If a person attempts to open the associated drawer, the force they exert in the first direction will be transferred from engagement member 86 to cam 80. Cam 80 will transfer this force to embossment 112 via its contact with stop surface 128. Due to the construction of cam 80, the force exerted by stop surface 128 against embossment 112 will generally be a vertical force that is perpendicular to first direction 64. The force exerted on sliding plate 78 through embossment 112 will therefore not tend to move sliding plate 78 in either first direction 64 or second direction 66. The pressure of stop surface 128 against embossment 112 will therefore not create any forces on engagement lug 104. Cable 74 is therefore shielded from the forces exerted on the drawer when the cable is in a taut condition.

If cable 74 is not in a taut condition when cam 80 rotates in direction 126, then sliding plate 78 will be free to move in first direction 64 after embossment 112 has cleared raised shoulder 124*a*. This movement of sliding plate 78 in first direction 64 will cause embossment 112 to also move in first direction 64. This movement of embossment 112 will allow it to fit into a channel 130 defined on cam 80. Channel 130 is suitably dimensioned to allow cam 80 to continue to rotate until channel 120 is angled enough to, allow engagement member 86 to exit channel 120. Thus, the drawer can be opened. The movement of embossment 117 into channel 130, which is caused by the biasing force of spring 82, will also cause engagement lug 104 to move in first direction 64. The movement of engagement lug 104 in first direction 64 will increase the tension in cable 74 to a taut condition. No other drawers will therefore be able to be opened simultaneously.

When the associated drawer is closed, engagement member will cause cam 80 to rotate in a direction opposite to the direction of its rotation when the drawer is opened. This closing rotation will cause a surface 131 on cam 80 to engage embossment 112. This engagement pushes embossment 112, and consequently sliding plate 74 in second direction 66. In order to avoid requiring excessive force to close the drawer, surface 131 may be angled at about 45 degrees when it contacts embossment 112. This allows sliding plate 78 to be pushed in second direction 66 without excessive forces.

Figure 17:
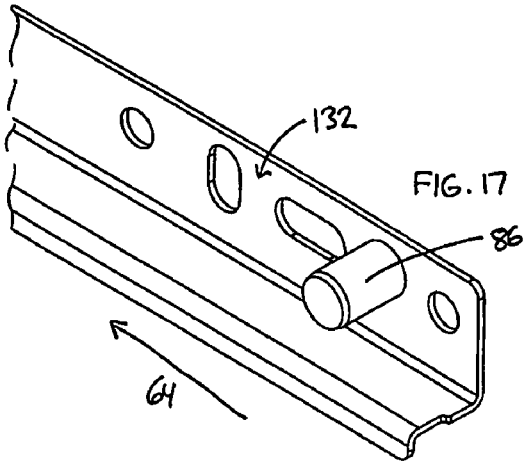
FIG. 17 is a perspective view of an engagement member of the interlock of FIG. 3.
Figure 18:
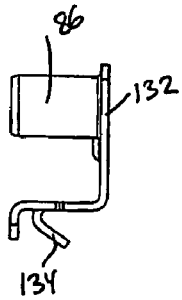
FIG. 18 is a front, elevational view of the engagement member of FIG. 17.
Figure 19:
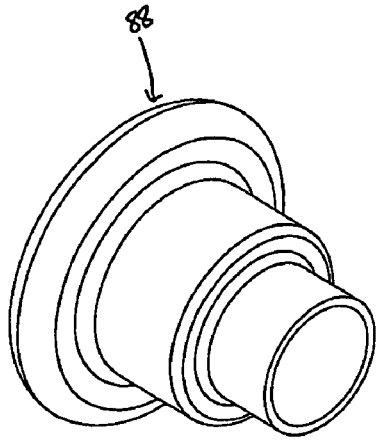
FIG. 19 is a perspective view of a rivet of the interlock of FIG. 3.
Figure 20:
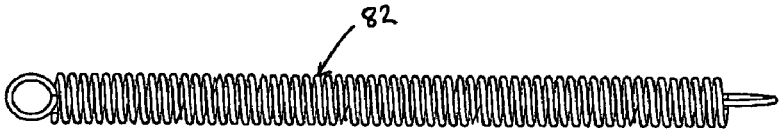
FIG. 20 is a side, elevational view of a spring of the interlock of FIG. 3.

Engagement member 86, which is depicted in more detail in FIG. 17, is attached to an elongated member 132. Elongated member 132 is fixedly secured to the drawer. Elongated member 132 is positioned on top of the drawer slide 70. Elongated member 132 includes various apertures that may be used to secure it to the drawer 62. Elongated member 132 includes a lower flange 134 that may be used to mount member 132 to drawer slide 70 (FIG. 18). Rivet 88 and spring 82 are depicted in FIGS. 19 and 20, respectively.

Cable guide 84, which is depicted in more detail in FIGS. 21-23 serves to ensure that cable 74 is properly maintained in contact with engagement lug 104 of sliding plate 78. Cable guide 74 may be manufactured of molded plastic. Cable guide 84 preferably snap-fittingly receives cable 84 so that cable 74 may be easily threaded into guide 84 with little danger of cable 74 becoming unthreaded. Cable guide 84 includes an upper and lower portion 136*a* and *b*. Channel 106 is defined between upper and lower portions 136*a* and *b*. As has been described, channel 106 provides clearance for sliding plate 78 and engagement lug 104. Cable guide 84 includes two glide surfaces 138 that provide support to sliding plate 78. Each portion 136*a* and *b* further includes an aperture 140. Apertures 140 receive bent flanges 98 of attachment plate 76 when cable guide 84 is attached thereto.

Apertures 140 are spaced apart in a vertical direction a distance that is slightly smaller than the vertical distance between shoulders 100 on flanges 98 of attachment plate 76. Thus, when flanges 98 are inserted into apertures 140, shoulders 100 contact and press against inner surfaces 142 of apertures 140. The dimensions of shoulders 100 force inner surfaces 142 to flex inwardly towards each other. When flanges 98 have been completely inserted into apertures 140, shoulders 100 have moved past inner surfaces 142, allowing them to flexibly snap back to their unstressed position. Shoulders 100 contact surfaces 144 of cable guide 84. Shoulders 100 thus prevent flanges 98 from being retracted out of apertures 140 without flexing inner surfaces 142 towards each other. Because shoulders 100 do not have a cam surface that facilitates removal of flanges 98 from apertures 140, cable guide 84 is securely retained on flanges 98 of attachment plate 76.

Cable 74 is easily threaded into cable guide 84 by moving cable 74 in direction 146 into channel 106 (FIG. 21). Movement of cable 74 in this direction causes the cable 74 to come in contact with two flexible arms 148. As cable 74 is further pushed against flexible arms 148, flexible arms 148 begin to flex out of the way until sufficient clearance is provided for cable 74 to pass by flexible arms 148. As soon as cable 74 passes by arms 148, they snap back to their unflexed condition. In this unflexed condition, cable 74 is prevented from being retracted out of channel 106 in a direction opposite the direction 146 by flexible arms 148. If an interlock 72 is to be removed from the inside of a cabinet, cable 74 can be easily removed from cable guide 84 by manually pressing flexible arms 148 in direction 146. Flexible arms 148 are pressed until sufficient clearance is provided for cable 74 to be retracted out of guide 84 in a direction generally opposite to direction 146.

FIGS. 4 and 5 illustrate a pair of interlocks 72*a* and 72*b* in different conditions. The cable 74 in FIGS. 4 and 5 is in a taut condition. The drawer that is attached to the drawer slide of interlock 72*b* is in a closed position. As has been described previously, first surface 122 of cam 80 is in contact with embossment 112 in this position. The drawer corresponding to interlock 72*a* illustrates the condition of interlock 72*a* when this drawer is trying to be opened and cable 74 is already in a taut condition due to either a lock or another interlock with its drawer open (not shown). Because cable 74 is in a taut condition, engagement lug 104 of sliding plate 78 (of interlock 72*a*) is prevented from moving further in first direction 64 than that illustrated in FIGS. 4 and 5. Because sliding plate 78 cannot move further in first direction 64, embossment 112 of sliding plate 78 cannot move out of the way of stop surface 128 on cam 80. Embossment 112 thus prevents cam 80 from further rotation while cable 74 is in the taut condition. Because cam 80 cannot rotate any further, engagement member 86 cannot disengage from channel 120 of cam 80. The drawer therefore cannot be opened. As noted, cable 74 of FIGS. 4 and 5 is in the taut condition due to another interlock with an opened drawer (not shown) that is in communication with cable 74. Alternatively, cable 74 could be in the taut condition because it is in communication with a lock that is moved to the locking position. FIG. 7 also illustrates an interlock 72 for a drawer that is trying to be opened when cable 74 is in the taut condition. Again, the taut condition of cable 74 is due to either a lock or another interlock that is not shown in FIG. 7.

Figure 24:
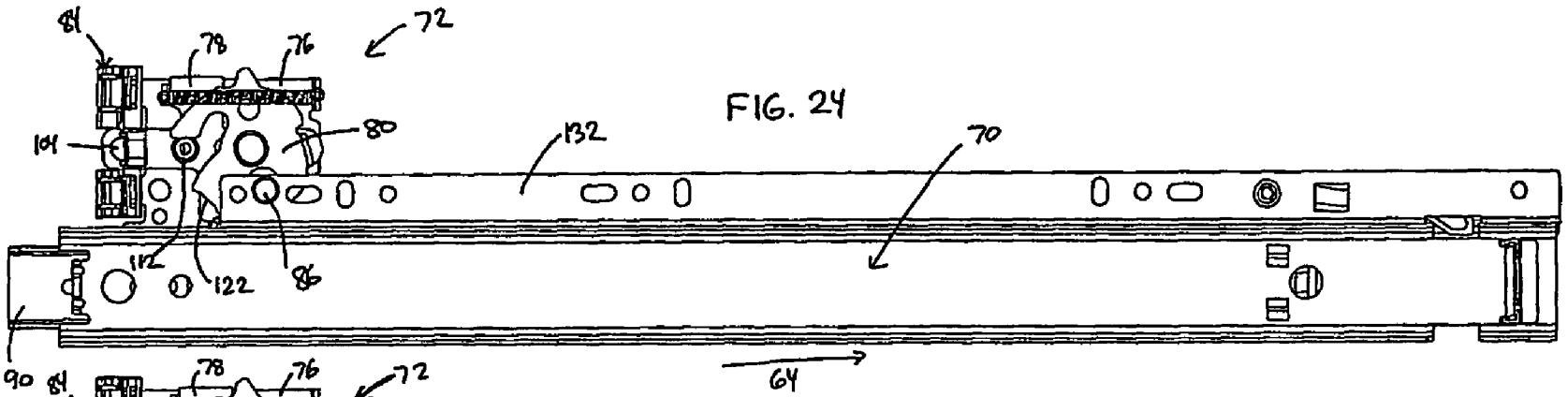
FIG. 24 is a side, elevational view of the interlock and drawer slide of FIG. 3 illustrated with the interlock in a locked position.

FIGS. 3 and 24-27 illustrate interlock 72 in its various positions according to different drawer conditions. FIG. 3 illustrates interlock 72 when the associated drawer is closed. FIG. 24 illustrates interlock 72 when the cable 74 has been changed to the taut condition by an un-illustrated interlock or lock and the drawer associated with interlock 72 is trying to be pulled open. The drawer is prevented from being opened by the engagement of stop surface 128 with embossment 112. Because stop surface 128 presses vertically down on embossment 112, sliding plate 78 does not experience a linear force in either first or second direction 64 or 66. Whatever force is exerted against the drawer in first direction 64 is therefore not translated to cable 74. Rather, cable 74 only experiences a tensioning force from interlock 72 that is due to spring 82 acting to pull engagement lug 104 in first direction 64. The tensile strength of cable 74 therefore does not appreciably limit the amount of force that can be applied to trying to open the locked door before the interlock system fails. Interlock 72 of the present invention may resist up to 150 pounds of force on a drawer, or more, before it fails. Further, this failure point will be due to cam 80 and its interaction with either embossment 112 or engagement member 86, not the tensile strength of cable 74. Interlock 72 thus shields cable 74 from the forces that are applied in first direction 64 to open locked drawers.

Figure 25:
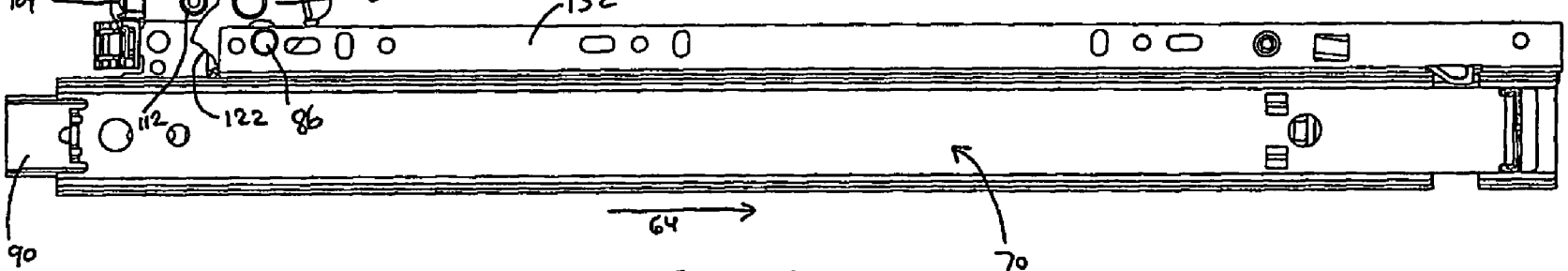
FIG. 25 is a side, elevational view of the drawer slide and interlock of FIG. 3 illustrating the interlock in a position in which two drawers are being simultaneously pulled toward an open position.

FIG. 25 depicts interlock 72 in the position it would move to when a person was trying to simultaneously open two drawers in the cabinet. Because no single drawer is fully open, cable 74 includes sufficient slack to allow embossment 112 to almost move past stop surface 128. However, embossment 112 cannot totally clear stop surface 128, and neither drawer will be able to be opened in this situation due to the partial engagement of stop surface 128 with embossment 112.

Figure 14:
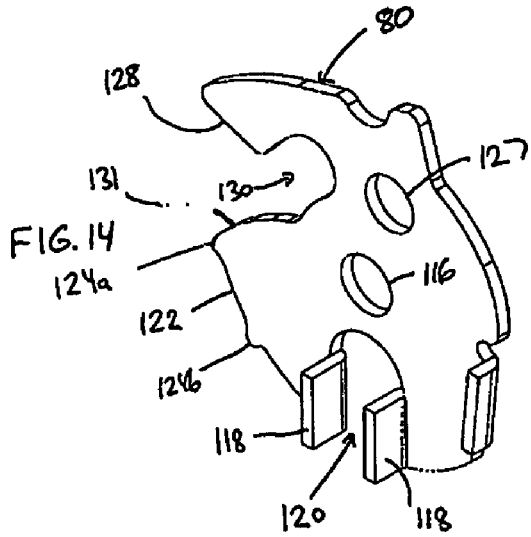
FIG. 14 is a perspective view of a cam of the interlock of FIG. 3.
Figure 15:
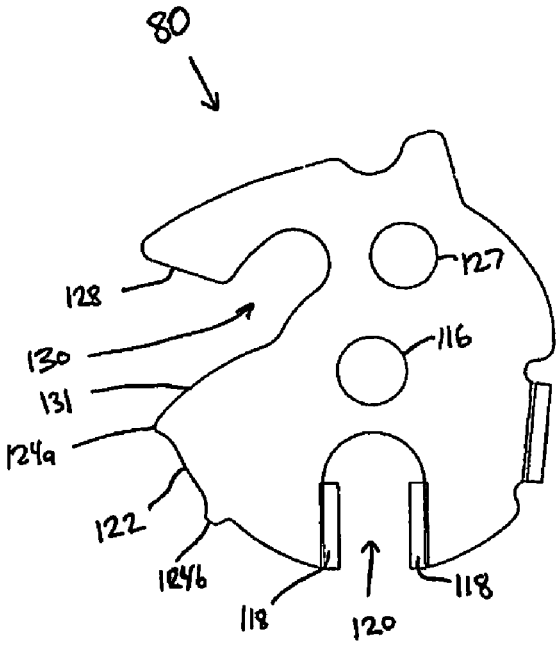
FIG. 15 is a plan view of the cam of FIG. 14.
Figure 16:
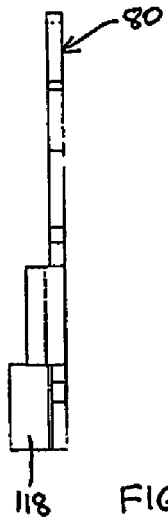
FIG. 16 is a side, elevational view of the cam of FIG. 14.
Figures 26, 27:
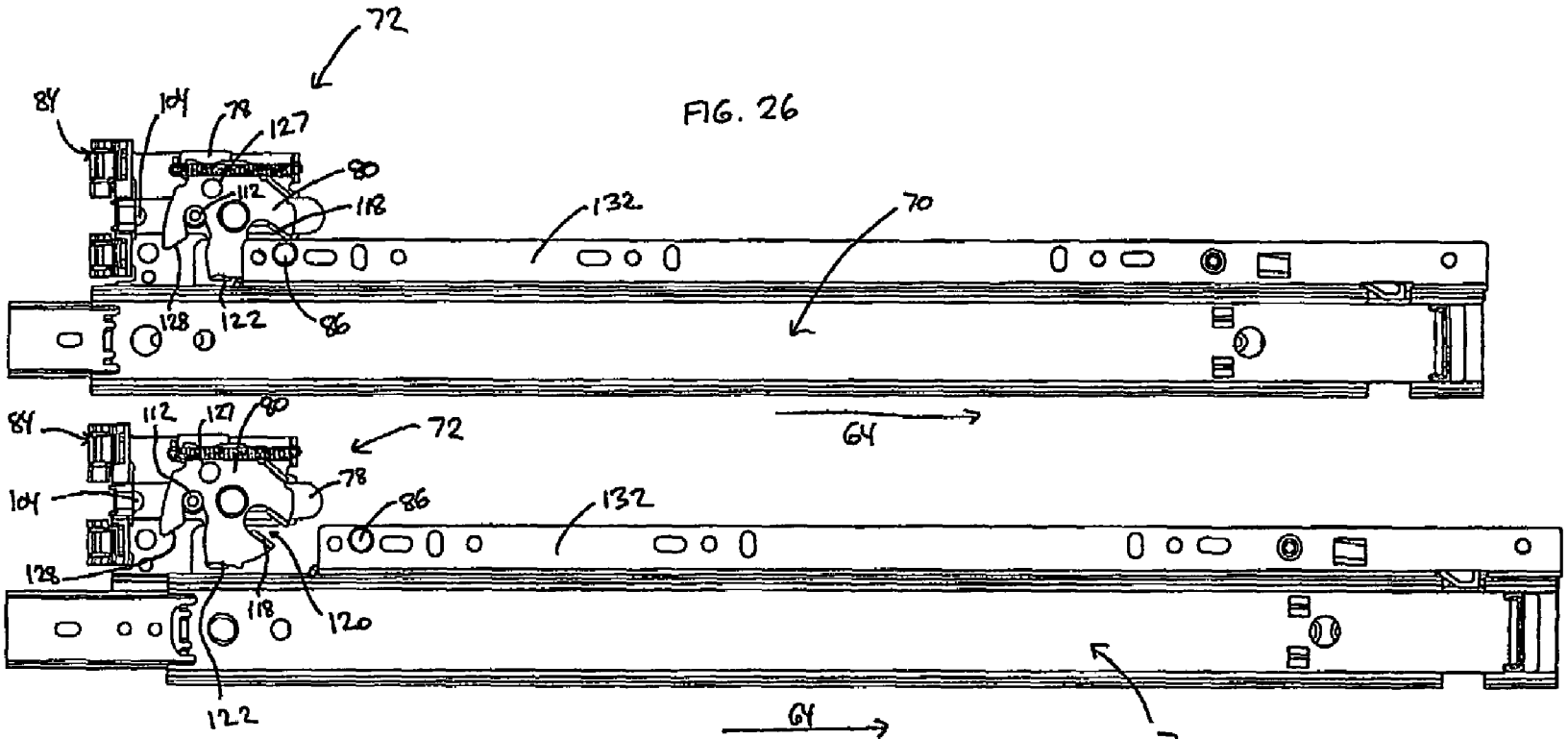
FIG. 26 is a side, elevational view of the drawer slide and interlock of FIG. 3 illustrating the interlock in an open position with the drawer slide contacting the CAM.
FIG. 27 is a side, elevational view of the drawer slide and interlock of FIG. 3 illustrating the interlock in an unlocked position, and the drawer slide disengaged from the cam.

FIG. 26 illustrates an interlock 72 in which the drawer associated with interlock 72 is partially open. As can be seen, embossment 112 has moved into channel 130 of cam 80. This has allowed cam 80 to rotate sufficiently to allow engagement member 86 to disengage from cam 80. The complete disengagement of engagement member 86 from cam 80 is illustrated in FIG. 27. FIG. 27 illustrates the condition of interlock 72 when the drawer is open to a greater extent than that depicted in FIG. 26. When the drawer of interlock 72 is moved back to its closest position, cam 80 must be oriented so that engagement member 86 can slide back into channel 120. In order to prevent cam 80 from inadvertently rotating out of this orientation while the drawer is fully opened, cam 80 can be appropriately weighted so that it is unlikely to rotate when engagement member 86 is disengaged. This weighting can be adjusted by cutting holes in cam 80 at appropriate locations to remove weight, such as hole 127 (FIGS. 14-16). Another flange, such as flange 129 (FIGS. 14-16) may also be added to increase the weight of cam 80 on a selected side of its pivot axis. Flange 129 may also be used to provide additional structural strength to cam 80 to help resist excessive pulling forces from engagement number 86 when the drawer is locked, but being attempted to be opened.

An interlock 72' according to a second embodiment of the present invention is depicted, either partially or wholly, in FIGS. 28-50. Interlock 72', like interlock 72, is adapted to be attached directly to a drawer slide 70'. While both interlocks 72 and 72' are depicted attached to the back ends of drawer slides 70 and 70', it will be appreciated that they can be attached to the drawer slides at any desirable location along the drawer slides' length. Interlock 72' operates in conjunction with a cable 74 in a similar manner that interlock 72 operates. Specifically, interlock 72' allows only a single drawer to be open at a given time. If a lock is included in the cabinet, the lock is in communication with cable 74 and can change the amount of slack in cable 74. If the lock is activated, cable 74 has little or no slack, and none of the drawers may be opened. Interlock 72' differs from interlock 72 in that a small portion of the pulling force exerted on a drawer in first direction 64 is transmitted to cable 74. Nevertheless, the amount of force transmitted is so small that a cable 74 having a relatively low tensile strength can still be used in a cabinet which provides strong resistance to its locking system being overcome.

Interlock 72' operates according to the same general principal as interlock 72 and is operatively coupled to a cable 74 that runs vertically inside of cabinet 60. Specifically, cable 74 is installed within the cabinet with a certain amount of slack. In general, interlock 72' operates according to the amount of slack in cable 74. When the first drawer of the cabinet is opened, the associated interlock 72' removes the slack from cable 74. As long as this drawer remains open, cable 74 remains in a low slack condition. The low slack condition of cable 74 prevents any other drawers from simultaneously being opened. When the one drawer is closed, cable 74 returns to its slack condition. In other words, cable 74 has two different basic levels of slack. When a single drawer is opened, interlock 72' takes up most of or all the slack in the cable 74 and creates a second, lower level of slack in cable 74. The lower level of slack in cable 74 is such that no other drawers in the cabinet can be opened. This lower level of slack may be zero, or may be a small amount of slack. When the drawer is closed, more slack in the cable returns. At that point, any other single drawer may be opened, or the same drawer may be opened again. If a lock is included, the lock is adapted to alter the slack in cable 74 when the lock is activated. In this activated state, no drawers may be opened in the cabinet. When in the unlocked condition, the lock allows cable 74 to have sufficient slack so that a single drawer may be opened. Interlocks 72' are thus designed to only allow their associated or attached drawer to be opened when cable 74 has sufficient slack. Further, they are designed to remove substantially all of the slack in cable 74, if their associated drawer is opened. The detailed construction and operation of interlock 72' will now be described.

Figures 28, 29, 30:
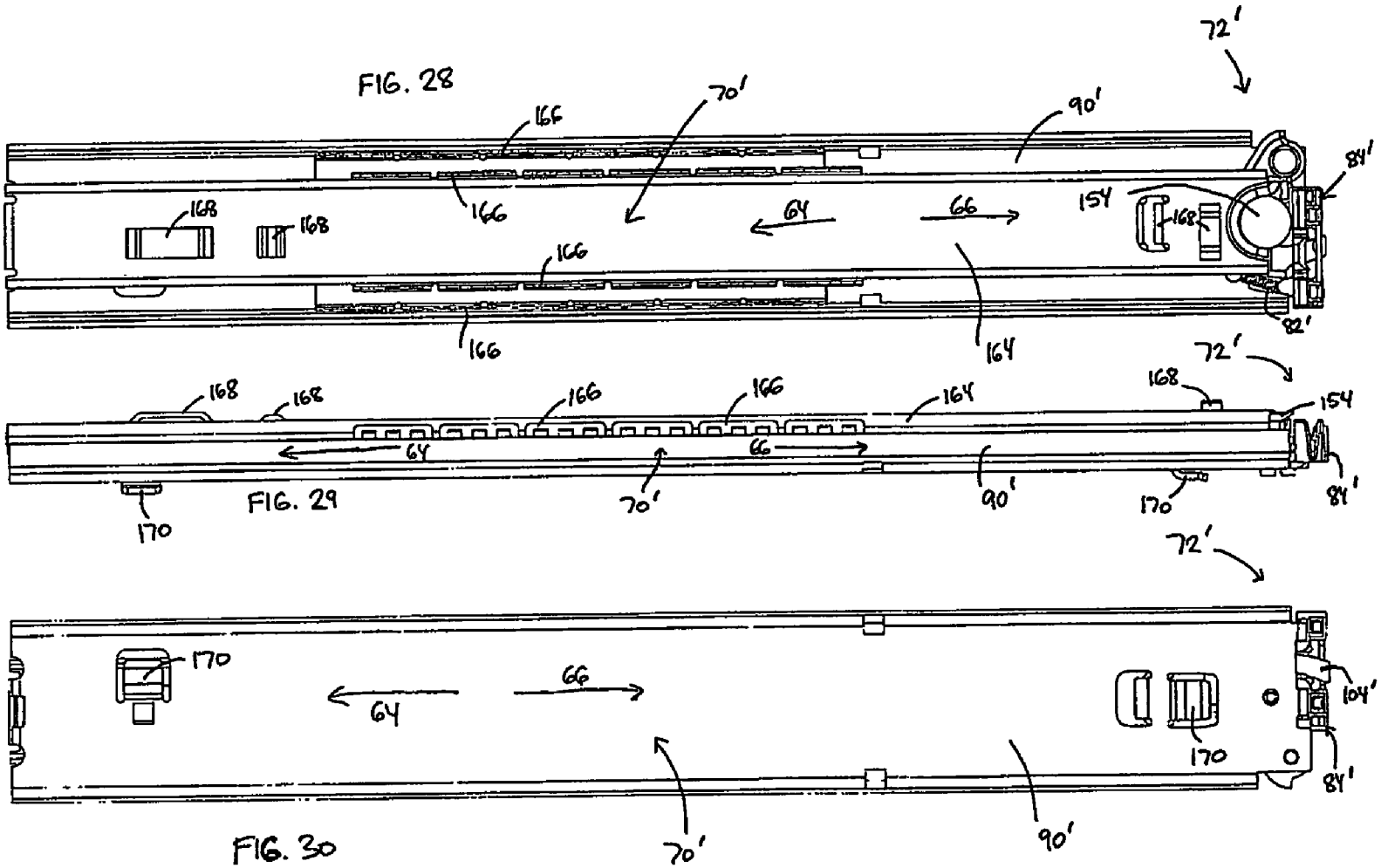
FIG. 28 is a side, devotional view of a drawer slide and interlock according to a second embodiment of the present invention.
FIG. 29 is a bottom view of the drawer slide and interlock of FIG. 28.
FIG. 30 is a side, elevational view of the drawer slide and interlock of FIG. 28 taken from a side opposite to that of FIG. 28.

For purposes of description, components of interlock 72' that are similar to components in interlock 72 will be described with the same reference numeral followed by the prime (C) symbol. Components of interlock 72' that are substantially different from components of interlock 72 will be described with a completely new reference numeral. As can be easily seen in FIG. 32, interlock 72' is attached to stationary portion 90' of drawer slide 70'. Stationary portion 90' is fixedly secured to the interior of cabinet 60. Stationary portion 90' includes an upper aperture 150 and a lower aperture 152. Upper aperture 150 receives a first rivet 154 that pivotally secures a lever 156 to stationary portion 90'. Lower aperture 152 receives a second rivet 158 that pivotally secures a cam 160 to stationary portion 90'. Interlock 72' further includes a cable guide 84' that is mounted to a pair of flanges 98' on stationary portion 90' in generally the same manner that cable guide 84 is mounted to attachment plate 76 of interlock 72. Interlock 72' further includes a spring 82' and an engagement member 86'. Engagement member 86' comprises a flange 162 that extends off of a slidable portion 164 of drawer slide 70'. Slidable portion 164 is slidable with respect to stationary portion 90' by way of a plurality of ball bearing cages 166 that house a plurality of ball bearings in contact with both slidable portion 164 and stationary portion 90' of drawer slide 70' (FIGS. 28-29). Slidable portion 164 is adapted to be secured to a drawer. Slidable portion 164 may include a plurality of attachment flanges 168 used to releasably secure slidable portion 164 to the drawer. Similarly, stationary portion 90' may also include a plurality of attachment flanges 170 used to releasably secure stationary portion 90' to the interior of the cabinet.

Lever 156, which is illustrated in more detail in FIGS. 32-35, is pivotable about a pivot axis generally defined by first rivet 154. Lever 156 includes an aperture 172 for receiving first rivet 154. Lever 156 includes a spring attachment nub 174 over which one end of spring 82' is secured. Lever 156 further includes an engagement lug 104' that engages cable 74. When lever 156 rotates about its pivot axis 176 in a direction 178 (FIG. 32), engagement lug 104' pulls against cable 74 decreasing the slack in cable 74. Spring 82' exerts a force on lever 156 that tends to resist rotation in direction 178.

Lever 156 includes an inner surface portion 180 and a crest 182. When a drawer is initially opened, cam 160 abuts against crest 182 and exerts a rotational force on lever 156. If cable 74 is not in a low slack condition, cam 160 pushes against crest 182 until lever 156 is rotated sufficiently to put cam 160 in contact with inner surface portion 180. This will be described in more detail below.

Figure 32:
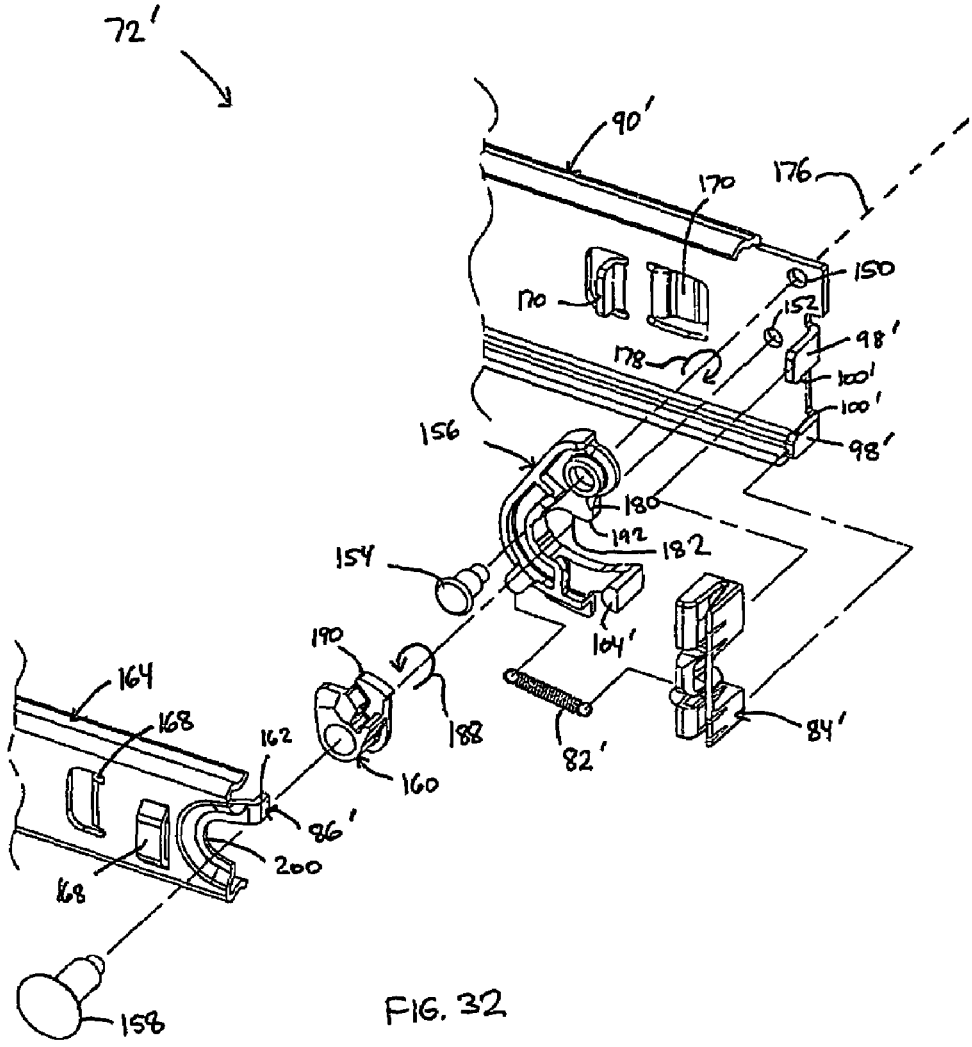
FIG. 32 is a perspective, exploded view of the components of the interlock of FIG. 28.
Figure 33:
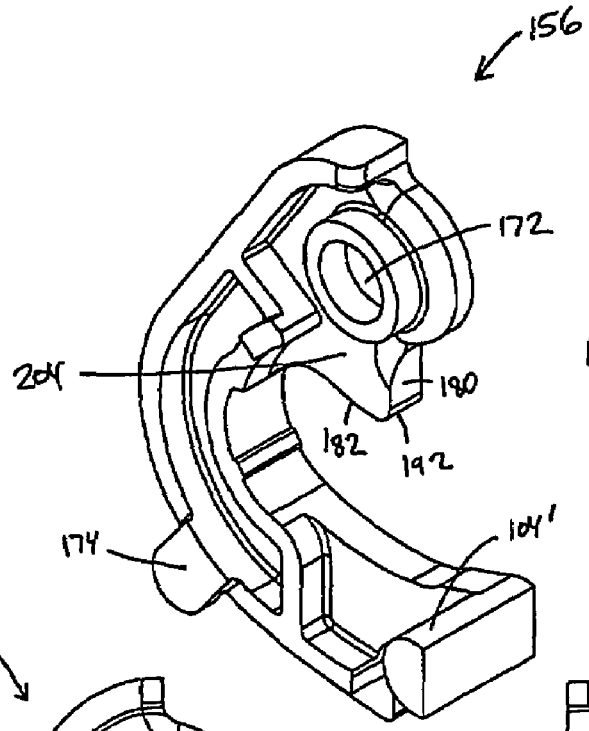
FIG. 33 is a perspective view of a lever of the interlock of FIG. 28.
Figure 34:
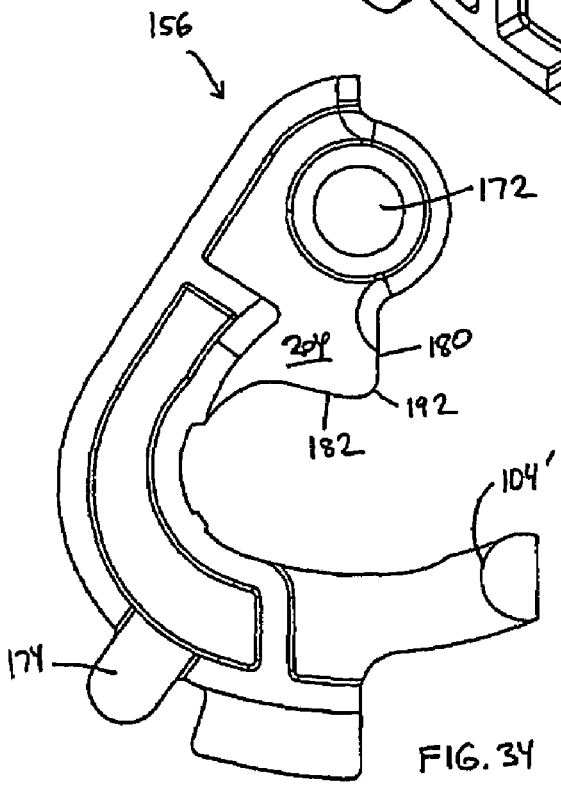
FIG. 34 is a plan view of the lever of FIG. 33.
Figure 35:
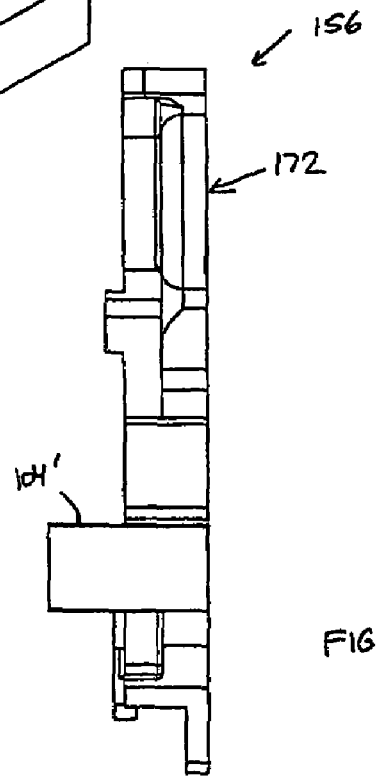
FIG. 35 is a side, elevational view of the lever of FIG. 33.
Figure 36:
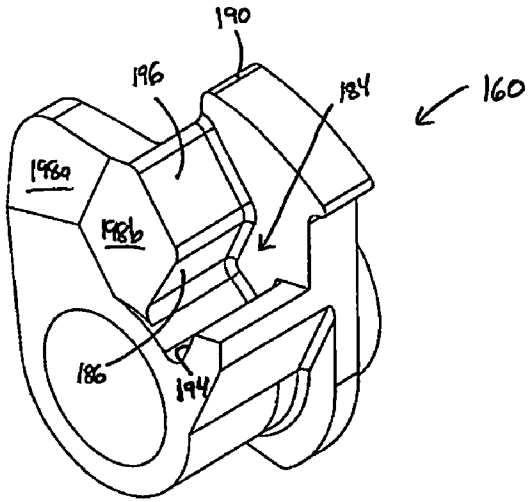
FIG. 36 is a perspective view of a cam of the interlock of FIG. 28.
Figure 39:
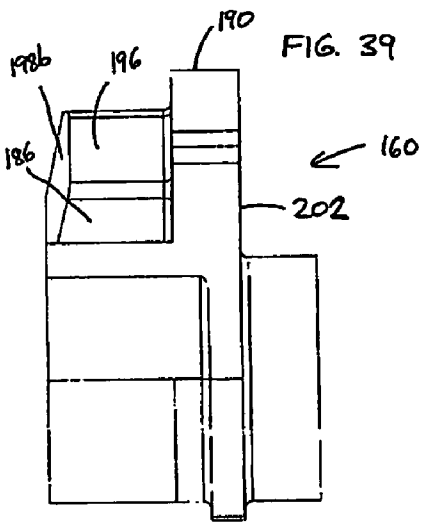
FIG. 39 is a side, elevational view of the cam of FIG. 36 taken from a side different from that of FIG. 37.
Figure 38:
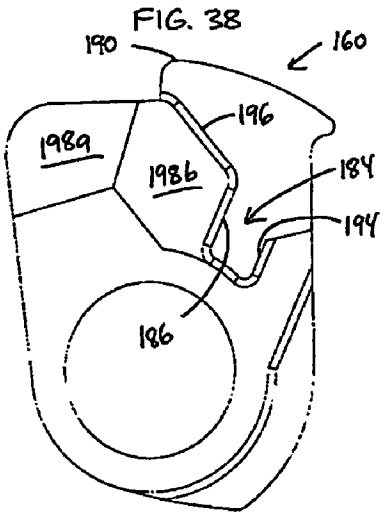
FIG. 38 is a plan view of the cam of FIG. 36.
Figure 37:
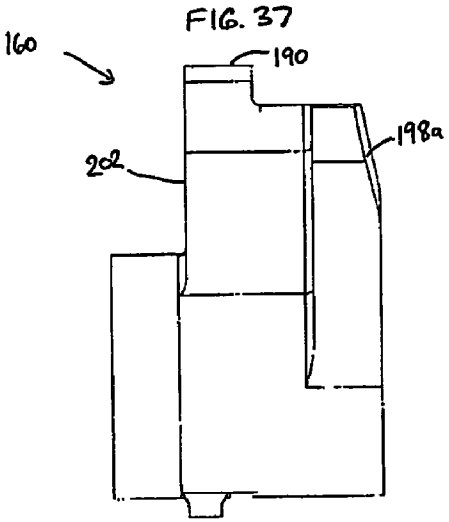
FIG. 37 is a side, elevational view of the cam of FIG. 36.

Cam 160, which is depicted in detail in FIGS. 32 and 36-39, is rotationally secured to stationary portion 90' of drawer slide 70' by way of second rivet 158. Cam 160 includes a recess 184 into which engagement member 86' fits when the associated drawer is in the closed position. Recess 184 includes a contact surface 186 that contacts engagement member 86' when the associated drawer is pulled in the first direction 64. When a drawer is pulled in first direction 64, engagement member 86' engages contact surface 186 and imparts a rotational force on cam 160. This rotational force is generally in the direction 188 (FIG. 32). Rotational direction 188 is the opposite of rotational direction 178. The rotation of cam 160 in direction 188 causes an edge 190 of cam 160 to press against crest 182 of lever 156. If sufficient rotational force is exerted on cam 160, edge 190 will push against lever 156 sufficiently to allow edge 190 to pass by the crest 182 on lever 156. Crest 182 may have an arced or radial surface that allows edge 190 to overcome it without a excessive force spike.

The rotation of cam 160 in direction 188 causes lever 156 to rotate in direction 178 (FIG. 32). The rotation of lever 156 takes up any slack in cable 74 by way of engagement member 86'. If cable 74 is already in a low slack condition, lever 156 will be prevented from rotating sufficiently far enough to allow edge 190 of cam 160 to reach inner surface portion 180 of lever 156. The full rotation of cam 160 will therefore be prevented. Engagement member 86' of slidable portion 164 of drawer slide 70' will therefore not be able to disengage from recess 184 in cam 160. Drawer slide 70' will therefore not be able to slide, and the attached drawer will not be able to open.

Figure 31:
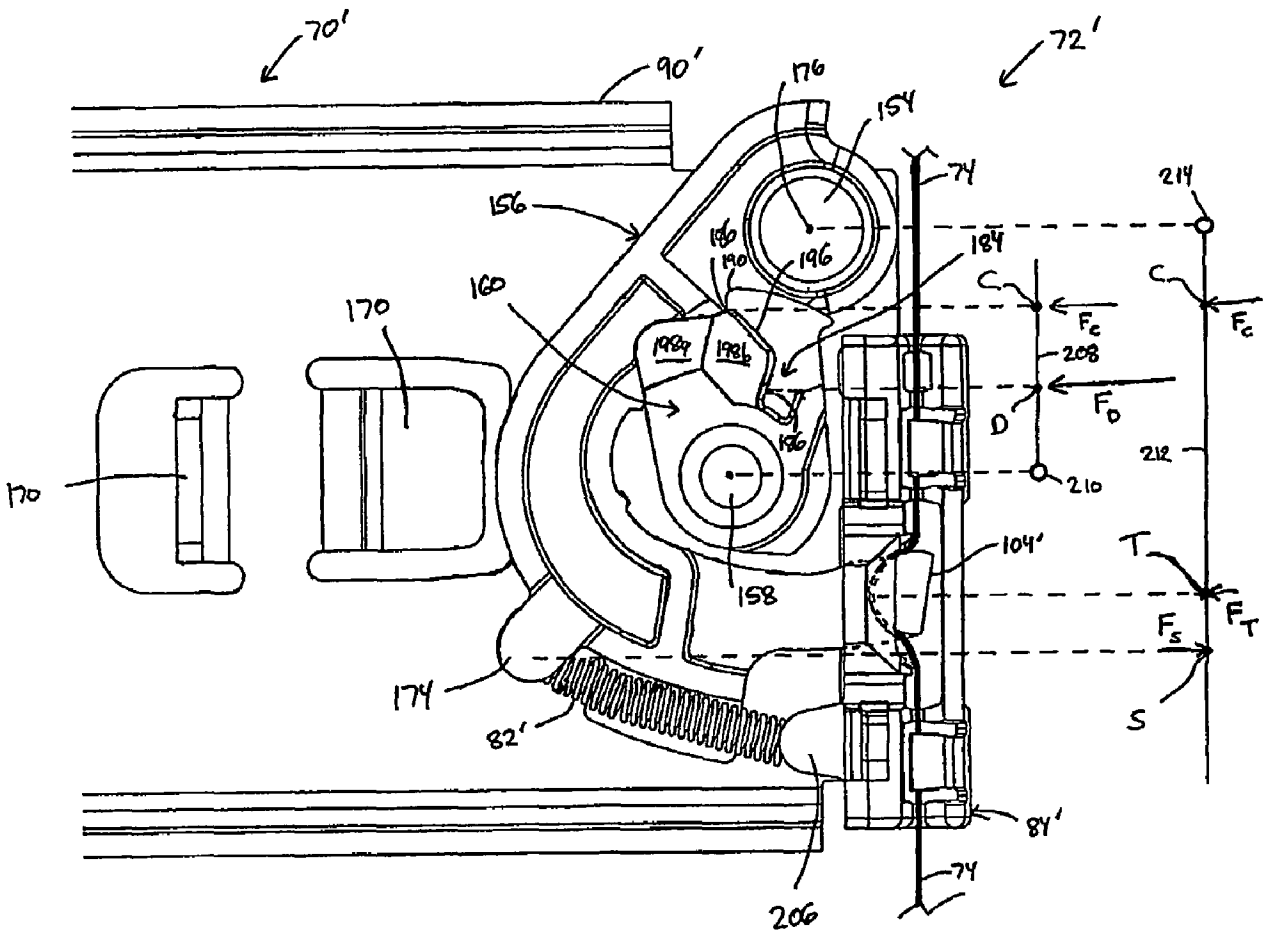
FIG. 31 is a front, elevational view of the interlock of FIG. 28.

When cable 74 is changed to a low slack condition by another interlock or lock, cam 160 cannot rotate further than the position depicted in FIG. 31. If cable 74 is not already in a low slack condition, then cam 160 will be able to rotate sufficiently far so that edge 190 contacts inner surface portion 180. When edge 190 is in contact with inner surface 180, cam 160 has rotated sufficiently far to allow engagement member 86' to disengage out of recess 184. Slide 70' is therefore free to slide and the attached drawer can be fully opened. When the drawer is fully open, spring 82' exerts a force on lever 156 in a direction opposite to rotational direction 178. This rotational force tends to maintain edge 190 in frictional contact with inner surface portion 180. This rotational force tends to maintain edge 190 in frictional contact with inner surface portion 180. This prevents edge 190 from sliding back to contact with crest 182 before the drawer is fully closed, and this maintains cam 160 in the proper rotational altitude for recess 184 to accept engagement member 86'. When the drawer is being closed, engagement member 86' eventually comes into contact with a contact surface 194 defined on cam 160. As the drawer is fully closed, engagement member 86' pushes against contact surface 194 to thereby cause cam 160 to rotate in a rotational direction that is opposite to direction 188. This rotation causes edge 190 to move out of contact with surface portion 180 and into contact with crest 182. This, in turn, allows lever 156 to rotate in a direction opposite to direction 178. This rotation causes engagement lug 104' to decrease the force on cable 74. The closing of the drawer therefore decreases any tension in cable 74 and increases its slack.

In addition, to maintain cam 160 in its proper rotational orientation when a drawer is opened, spring 82' helps prevent the drawers from rebounding open, or partially open, after they are slammed shut. Without spring 82', it might be possible for a drawer to be slammed shut with sufficient force such that the rebound of the drawer in first direction 64 might rotate earn 160 and allow the drawer to open up again. Spring 82' helps prevent such rebounding of the drawers into the open position by biasing lever 156 in a direction that resists the rotation of cam 160. The amount of biasing is sufficient to generally overcome the amount of force typically present in a drawer rebound. The drawers therefore do not rebound open, but rather only open when a user applies sufficient force to overcome the biasing resistance that spring 82' exerts.

Cam 160 includes a sloped surface 196 that helps ensure that engagement member 86' is successfully guided back into recess 184 when a drawer is closed. If engagement member 86' contacts sloped surface 196, it will exert a rotational force on cam 160 that tends to rotate cam 160 so that recess 184 is properly aligned for receiving engagement member 86'. Cam 160 further includes chamfered surfaces 198*a* and *b*. Chamfered surfaces 198*a* and 198*b* are designed to urge slidable portion 164 of drawer slide 70' into proper axial alignment with cam 160. Stated alternatively, if slidably portion 164 of drawer slide 70' is compressed toward stationary portion 90', chamfered surface 198 will contact an end flange 200 on slidable portion 164 and urge it away from stationary portion 90' (FIG. 32). Second chamfered surface 198*b* will continue to urge slidable portion 164 away from stationary portion 90' as the drawer is completely closed. Chamfered surfaces 198*a* and *b* therefore serve to help maintain the proper spacing of stationary portion 90' with respect to slidable portion 164.

Cam 160 further includes a slide surface 202 that contacts a respective slide surface 204 on lever 156 (FIGS. 33-39). Slide surfaces 202 and 204 help ensure that cam 160 and lever 156 maintain the proper axial position with respect to each other as they are rotated. Edge 190 of cam 160 may preferably be arced with a radius of 0.04 inches. Crest 182 may also be arced with a radius of 0.06 inches. Other values may, of course, be used. Rounding edge 190 and crest 182 reduces the amount of force necessary to open the drawer. However, rounding these surfaces excessively will cause more of the force exerted on a locked drawer to be transferred to the cable 74.

Figure 40:
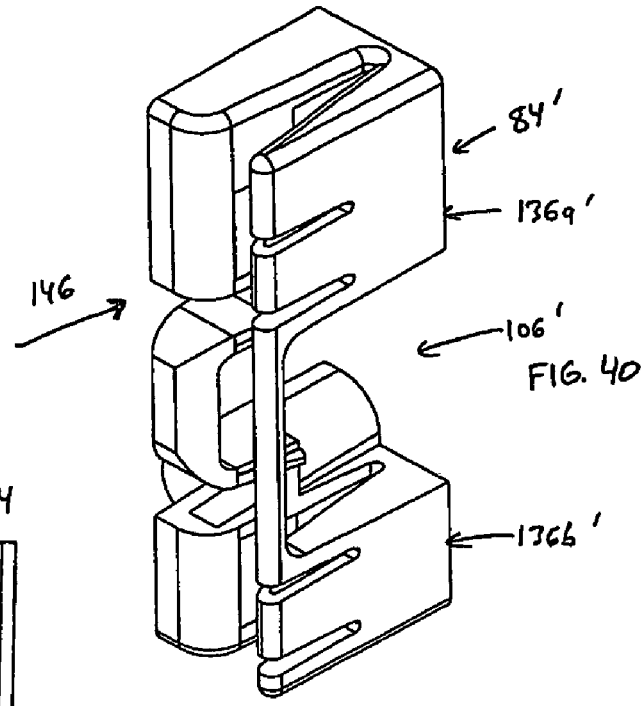
FIG. 40 is a perspective view of a cable guide of the interlock of FIG. 28.
Figure 41:
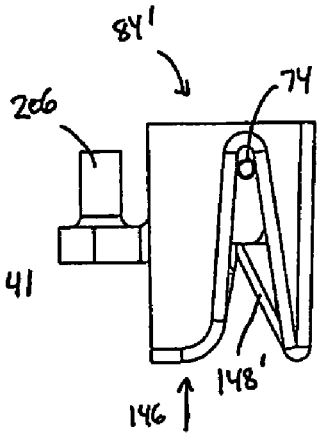
FIG. 41 is a front, elevational view of the cable guide of FIG. 40.
Figure 42:
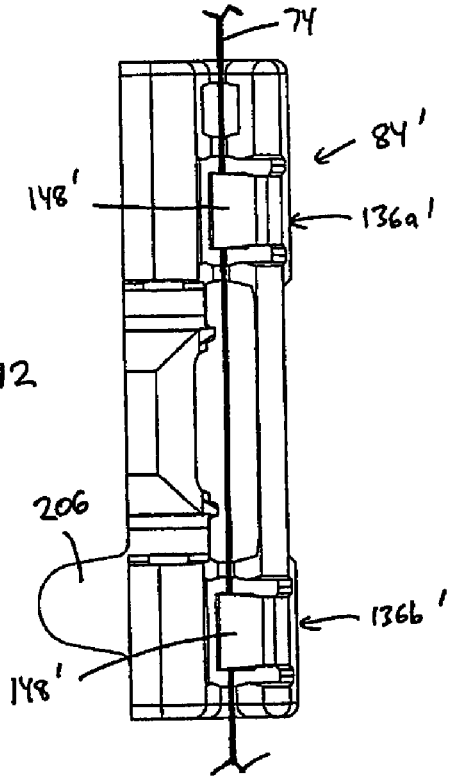
FIG. 42 is a bottom view of the cable guide of FIG. 40.

Cable guide 84', which is depicted in detail in FIGS. 40-42, serves to ensure that cable 74 is properly maintained in contact with engagement lug 104' of lever 156. Cable guide 74 may be manufactured of molded plastic. Cable guide 84' preferably snap-fittingly receives cable 84' so that cable 74 may be easily threaded into guide 84' with little danger of cable 74 becoming unthreaded. Cable guide 84' includes an upper and lower portion 136*a* and 136*b*. A channel 106 is defined between upper and lower portions 136*a* and 136*b*.

Cable 74 is easily threaded into cable guide 84' by moving cable 74 in direction 146 into channel 106 (FIG. 40). Movement of cable 74 in this direction causes the cable 74 to come in contact with two flexible arms 148. As cable 74 is further pushed against flexible arms 148, flexible arms 148 begin to flex out of the way until sufficient clearance is provided for cable 74 to pass by flexible arms 148. As soon as cable 74 passes by arms 148, they snapback to their unflexed condition. In this unflexed condition, cable 74 is prevented from being retracted out of cable guide 74 in a direction opposite the direction 146 by flexible antis 148. If an interlock 72 is to be removed from the inside of a cabinet, cable 74 can be easily removed from cable guide 84' by manually pressing flexible arms 148 in direction 146. Flexible arms 148 are pressed until sufficient clearance is provided for cable 74 to be retracted out of guide 84' in a direction generally opposite to direction 146. Cable guide 84' includes a spring attachment nub 206 that holds an end of spring 82' opposite spring attachment nub 174 on lever 156. Cable guide 84' includes recesses (not shown) that receive flanges 98' and that interact with the shoulders 100' to secure guide 84' to stationary portion 90'. These recesses are defined on the bottom of cable guide 84' and do not extend all the way through cable guide 84. Shoulders 100 abut against surfaces 144 when cable guide 84' is attached to stationary member 90' (FIG. 42).

Figure 43:
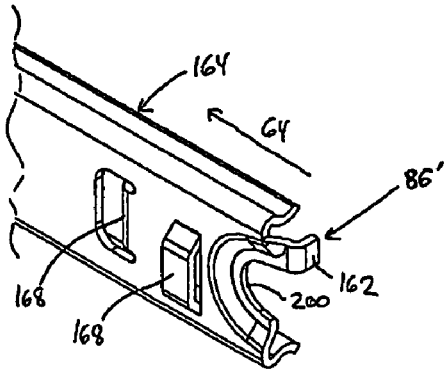
FIG. 43 is a partial, perspective view of a drawer slide member with an engagement member for engaging the interlock of FIG. 28.
Figure 44:
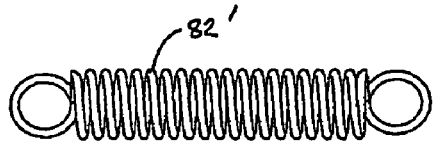
FIG. 44 is a side, elevational view of the spring of the interlock of FIG. 28.
Figure 45:
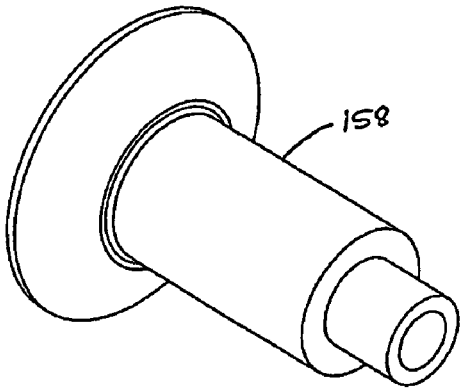
FIG. 45 is a perspective view of a rivet of the interlock of FIG. 28.
Figure 46:
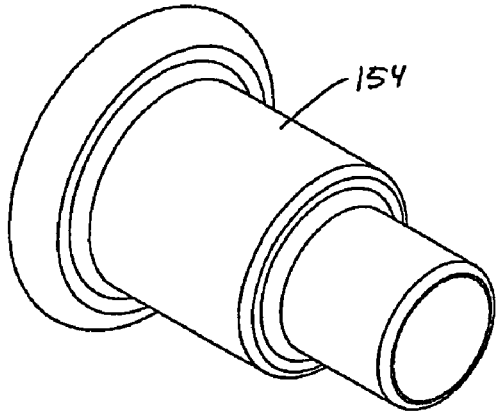
FIG. 46 is a perspective view of another rivet of the interlock of FIG. 28.

FIG. 43 depicts slidable portion 164 of drawer slide 70' in more detail. FIG. 44 depicts spring 82' in more detail. FIGS. 45 and 46 depict first and second rivets 154 and 158 respectively. Second rivet 158 includes a sloped undersurface 159 (FIG. 45) that helps to maintain slideable portion 164 of the drawer slide, as well as the attached drawer, in proper alignment with the stationary portion 90'. If the drawer is subjected to pulling forces, or other types of forces, that tend to cause the drawer to rack or twist (especially if made out of thin sheet metal), these forces may move the back end of slideable portion 164 away from stationary portion 90'. In such instances, end flange 200 will come into contact with sloped undersurface 159 of rivet 158 as the drawer is closed. The sloped nature of surface 159 will create a force on end flange 200 of slideable portion 164 that pushes the back end of slideable portion 164 toward stationary portion 90' in a direction generally parallel to pivot axis 176. This helps maintain the proper alignment of the drawer when it is closed. End flange 200 may be chamfered to correspond to the angle of undersurface 159 in order to more easily force the drawer into the proper alignment. Undersurface 159 also helps to ensure that engagement member 86' stays aligned with cam 160 so that engagement member 86' properly engages cam 160. Without rivet 158 and undersurface 159, it might be possible for a drawer to become excessively racked such that engagement member 86' no longer contacted cam 160 when the drawer was opened and closed. Undersurface 159 prevents this possibility.

The head of rivet 158 preferably does not extend farther away from the stationary portion 90 than does slidable portion 164. Rivet 158, therefore, does not obstruct the drawer attached to slidable portion 164 and the back end of the drawer may extend all the way back to the back end of the drawer slide. Interlock 72, therefore, does not put any space limitations on the dimensions of the drawer other than those required by the drawer slide.

As mentioned previously, interlock 72' is designed to transfer only a small fraction of a pulling force exerted on a drawer onto cable 74. This reduction in forces can best be understood with reference to FIG. 31. FIG. 31 illustrates interlock 70' in the position it would be in when the attached drawer is being pulled in the open direction while cable 74 is in a taut or low slack condition. The tautness of cable 74 prevents interlock 70 from allowing the drawer to be opened. FIG. 31 depicts interlock 72' with slidable portion 164 and second rivet 158 removed in order to illustrate the underlying structure. Line 208 represents the moment arm of cam 160 as it pivots about its pivot point 210 (corresponding to the center of rivet 158). Line 212 represents the moment arm of lever 156 as it pivots about its pivot point 214 (corresponding to the center of rivet 154). For purposes of discussing the forces applied to interlock 72', it will be assumed that the cable 74 depicted in FIG. 31 is already in a low slack condition due to either an associated lock being activated, or another interlock having allowed another drawer to be opened. Interlock 72' depicted in FIG. 31 therefore must prevent its attached drawer from opening in order to function properly. If a person exerts a strong pulling force on the drawer attached to interlock 72' of FIG. 31, this force will be greatly reduced when it is eventually applied to cable 74. The pulling force exerted on the drawer in first direction 64 is transmitted to cam 160 by engagement member 86'. Engagement member 86' engages cam 160 generally in recess 184. The pulling force exerted on the drawer, which is illustrated by the arrow $F_D$, acts on moment arm 208 at a point D. This point corresponds to the location where engagement member 86' contacts first surface 186 of recess 184. Force $F_D$ will cause cam 160 to rotate generally in a counter clock-wise direction, as depicted in FIG. 31. This rotation will cause edge 190 of cam 160 to push against crest 182 of lever 156 with a force of $F_C$. $F_C$ refers to the amount of force exerted by cam 160 on lever 156. Because force $F_C$ will be applied by cam 160 at a location that is farther away from pivot point 210 on moment arm 208, force $F_C$ will be less than force $F_D$.

The force $F_C$ will be applied to moment arm 212 of lever 156 at a position C. Position C is located on moment arm 212 at a position that is relatively close to pivot point 214. Force $F_C$ will be transferred via lever 156 to cable 74 at a point T. Point T refers to the position where engagement lug 104' engages cable 74. Because point T is substantially farther away from pivot point 214 along moment arm 212, the magnitude of force $F_T$ will be significantly less than the magnitude of force $F_C$. Further, the spring 81' will exert a force $F_S$ along lever 156 at a point S. This force $F_S$ acts in opposition to the force $F_T$. Because point S is farther away from pivot point 214 along moment arm 212, a smaller amount of force $F_S$ is necessary to cancel out the force $F_T$. The force $F_T$ that is exerted against cable 74 will therefore be greatly reduced as compared to the force $F_D$ that is exerted on the drawer. The tensioning force $F_T$ may be as little as 1/20th, or less, of the magnitude of the force $F_D$. Cable 74 can therefore resist drawer-pulling forces that greatly exceed its maximum tensile strength.

In addition to transferring only a fraction of the force of $F_D$ to cable 74, the arrangement of cam 160 and lever 156 also magnifies the movement of engagement lug 104' with respect to the rotation of cam 160. Stated alternatively, if the attached drawer is moved in first direction 64 a small distance A that causes cam 160 to partially rotate, the distance that engagement lug 104' moves in first direction 64 will be greater than the distance A. For example, if the drawer is moved in first direction 64 for 0.05 inches, this may cause engagement lug 104' to move 0.65 inches. This feature decreases the amount of movement in the locked drawers that might otherwise be present. A drawer that is locked will therefore only be able to be pulled a small distance before taut cable 74 prevents it from being opened. Interlock 72' can thus prevent drawers from being opened even for the small distance that might otherwise easily allow an intruder to insert a screw driver, or other lever mechanism, between the drawer and the cabinet.

Figure 47:
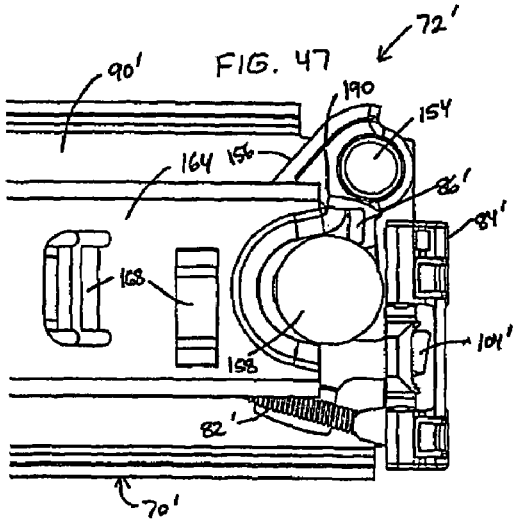
FIG. 47 is a side, elevational view of the interlock of FIG. 28 illustrated in a lock position.
Figure 48:
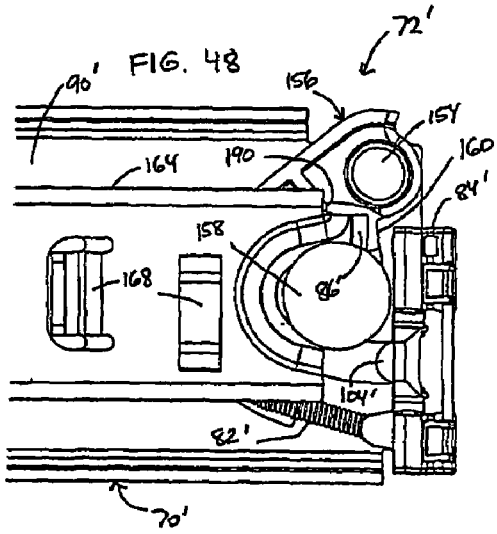
FIG. 48 is a side, elevational view of the interlock of FIG. 28 illustrated in a position in which two drawers are being simultaneously pulled toward the open position.

FIGS. 47-50 depict interlock 72' in several different states. In FIG. 47, interlock 72' is in the position it would be if someone were pulling on the attached drawer while the cable 74 (not shown) was in a low slack condition. The cable 74 would therefore prevent cam 160 in lever 156 of interlock 72' from rotating further than that depicted in FIG. 47. FIG. 48 depicts the position of interlock 72' when the drawer is trying to be pulled open simultaneously with another drawer. When two drawers are trying to be opened simultaneously, lever 156 can rotate more than it can in FIG. 47. However, the rotation of lever 156 is insufficient to allow edge 190 of cam 160 to travel past crest 182. Cam 160 therefore does not rotate sufficiently to allow engagement lever 86' to disengage from recess 184. Therefore, neither drawer being simultaneously pulled will allow it to be opened.

Figure 49:
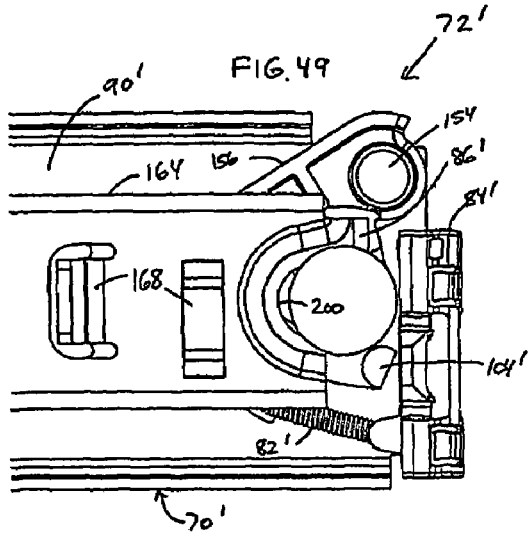
FIG. 49 is a side, elevational view of the interlock of FIG. 28 illustrating the interlock in an unlocked position with the engagement member in contact with the cam.
Figure 50:
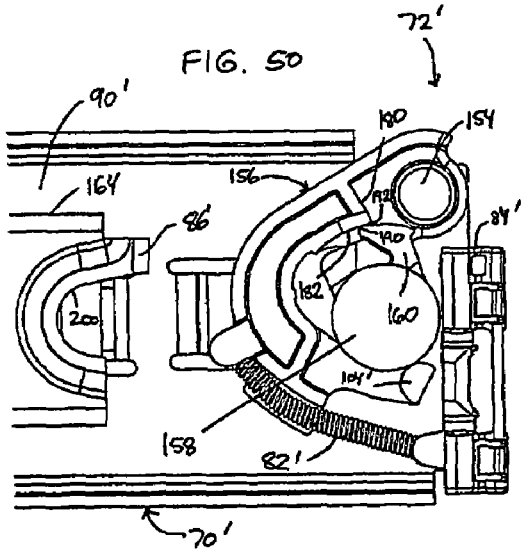
FIG. 50 is a side, elevational view of the interlock of FIG. 28 illustrated in an unlocked position in which the engagement member of the slide has moved out of engagement of the cam.

FIG. 49 depicts interlock 72' in its condition when engagement member 86' has just begun to disengage from recess 184. Engagement member 86' has moved to a greater extent than in FIGS. 47 and 48. This greater movement creates sufficient force against cable 74 (not shown) to put the cable in a low slack condition, thereby preventing other drawers from being opened simultaneously. With surface 190 in contact with surface 180, lever 156 is prevented from rotating back, thereby maintaining cable 74 in the lower slack state when another drawer is attempted to be opened. FIG. 50 depicts an interlock 72' in which the drawer has opened sufficiently far to disengage engagement member 86' from recess 184.

An example of a lock 216 that may be used in conjunction with the present invention is depicted in FIGS. 51-55. Lock 216 selectively changes the condition of cable 74 from a low slack condition to a low slack condition. Lock 216 includes a hole 260, which may be a keyhole, into which a key may be inserted or which may receive a bar that is coupled to a conventional lock cylinder. If hole 260 is a keyhole, insertion of the proper key therein allows a key cylinder 218 to be rotated by the key. If hole 260 received a bar, which may be desirable where lock 216 is positioned at the back end of the cabinet, the bar is coupled to any conventional lock in a manner that causes the bar to be able to rotate about its longitudinal axis when the proper key is inserted into the conventional lock. In either situation, key cylinder 218 therefore will rotate when a proper key is used. Key cylinder 218 includes a pin 220 that moves in a cam track 222 defined in a reciprocating member 224. Reciprocating member 224 is snap-fittingly attached to a cover 226 by way of a flexible arm 228. Flexible arm 228 fits into an aperture 230 defined in cover 226. Flexible arm 228 includes a shoulder 232 that retains reciprocating member 224 to cover 226 when the two are snap fit together. The snap fitting occurs when flexible arm 228 initially contacts cover 226. A cam surface 234 causes flexible arm 228 to flex as reciprocating member 224 is initially pushed toward cover 226. After the two are completely secured together, flexible arm 228 snaps back to its unflexed condition in which shoulder 232 prevents the two members from being separated.

Figure 51:
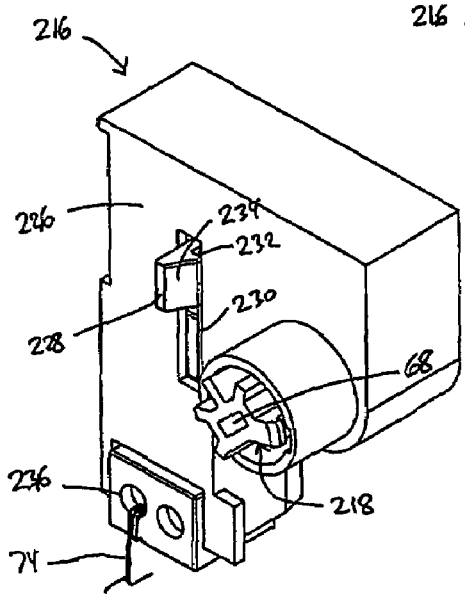
FIG. 51 is a perspective view of a lock illustrated in a locked position.
Figure 52:
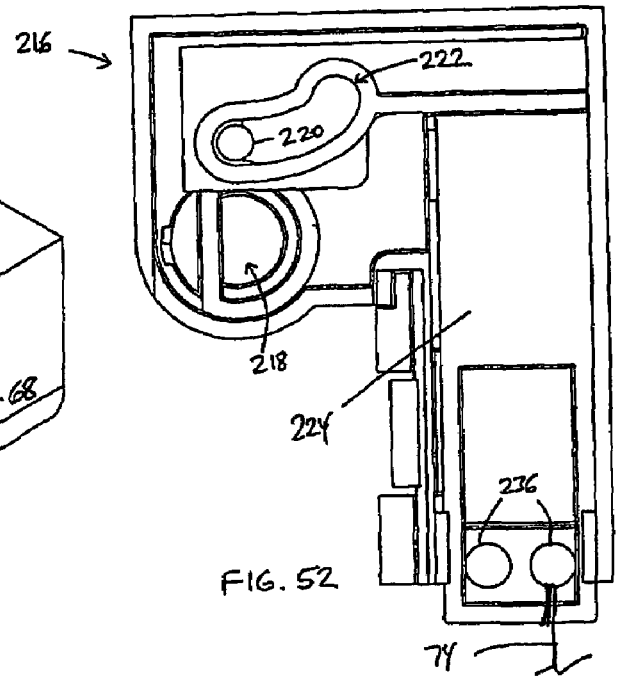
FIG. 52 is a side, elevational view of the lock of FIG. 51.
Figure 53:
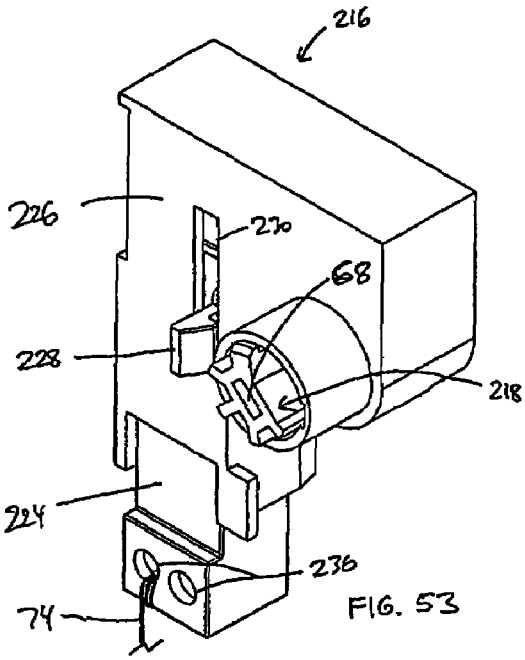
FIG. 53 is a perspective view of the lock of FIG. 51 illustrated in an unlocked position.
Figure 54:
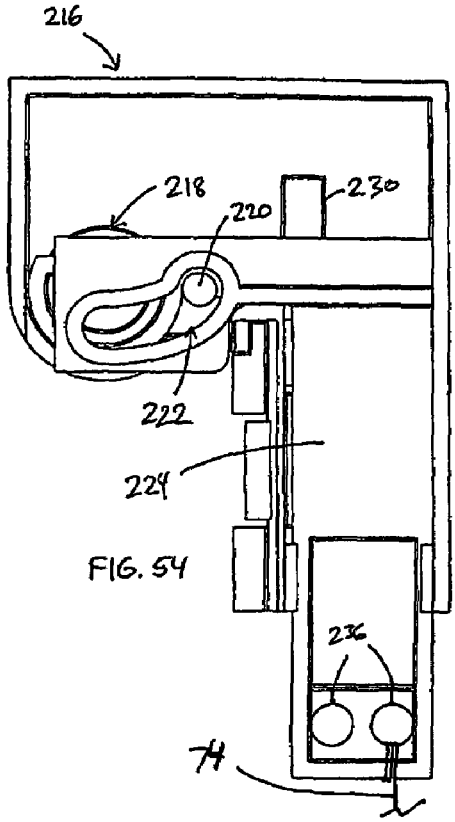
FIG. 54 is a side, elevational view of the lock of FIG. 53.

Reciprocating member 224 includes a pair of apertures 236. Cable 74 may be secured to one of the apertures 236. When key cylinder 218 is rotated toward a locking condition, reciprocating member 224 moves vertically upward with respect to cover 226 (FIGS. 51-52). This vertical movement decreases the slack in cable 74 such that no drawers in the cabinet may be opened. When lock 216 is unlocked, the unlocking rotation of key cylinder 218 moves reciprocating member 224 vertically downward with respect to cover 226 (FIGS. 53-54). This creates sufficient slack in cable 74 for a single drawer to be opened. Cover 226 may be securely fastened inside of cabinet 60 in any suitable manner.

Figure 55:
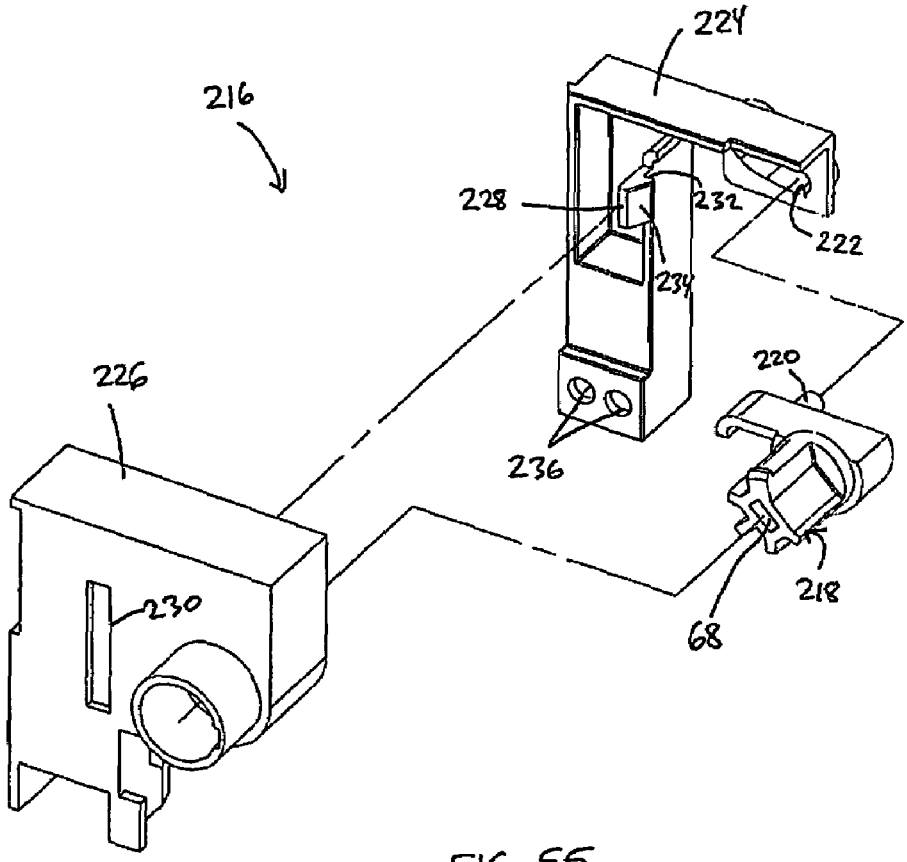
FIG. 55 is a perspective, exploded view of the lock of FIG. 51.

Cable 74 may be secured to one of apertures 236 by threading the cable therethrough and tying it, such as is illustrated in FIGS. 51-54. Alternatively, a more preferred method of securing cable 74 to apertures 236 is accomplished by way of a 7-hook 300 (FIG. 55). J-hook 300 is crimped onto an end of cable 74 in a conventional manner. J-hook 300 includes a lower vertical section 302, a middle horizontal section 304, and an upper vertical section 306. Upper vertical section 306, along with a portion of horizontal section 304, is inserted through one of apertures 236 and manipulated until upper vertical section 306 contacts one side of the wall in which apertures 236 are defined and is oriented vertically. In this position, horizontal section 304 passes horizontally through the aperture 236 and lower vertical section 302 abuts against a side of the wall in which aperture 236 is defined that is opposite the side contacting upper section 306. In this position, J-hook 300 is maintained in aperture 236 and can only be released by manually twisting 7-hook 300 appropriately to allow upper section 306 to be backed out of aperture 236. 7-hook 300 thus provides a convenient way for installing and removing cable 74 from lock 216.

The opposite end of cable 74 may also be fastened within a cabinet by using a J-hook that fits through an aperture attached to the cabinet, although any other method of securing cable 74 can be used with the present invention. If it is desired to avoid having an end of cable 74 be attached to the frame of the cabinet, it could alternatively be held in place by interacting with cable guide 84'. Specifically, an enlarged ring or other structure could be affixed to the end of the cable. This enlarged structure would be dimensioned so that it was too large to pass through the cable passageway defined in cable guide 84. For securing the bottom of the cable, the enlarged structure would thus abut against a bottom surface 310 of the lower-most cable guide 84' (FIGS. 40-42). If it were desired to secure the top end of the cable in a like manner to a cable guide 84', rather than to a lock 216, an enlarged structure could also be attached to the top end of cable 74. In this situation, the enlarged structure would abut against a top surface 312 of the uppermost cable guide 84'. The enlarged structure may preferably be shaped to snap onto, or otherwise be secured to, cable guide 84'. If an enlarged structure were used on both ends of the cable to secure it in the cabinet, the proper cable slack could be set by manufacturing the cable to the specific length that created the desired amount of slack.

Lock 216 could be modified so that reciprocating member 224 utilized a spring or other structure that selectively increased or decreased the tension on cable 74. In other words, rather than having reciprocating member 224 absolutely move to is raised position when the key is rotated to the locked position, lock 216 could be modified to include a spring, or other biasing force, that urged member 224 towards its upper, locked position. If no drawers were open, this biasing force would be sufficient to raise member 224 to its locked position. If one drawer were open, this biasing force would be insufficient to move the member 224 to its upper position because the cable would be in its low slack condition, thereby preventing member 224 from moving upward while the drawer was opened. As soon as a drawer was closed, however, the biasing force would move member 224 to is locked position and remove the slack in the cable that was created by the drawer closing.

This arrangement allows the lock to be switched to the locked position while a drawer is still open. Once the drawer closed, it would immediately be locked and not able to be opened until the lock 216 was deactivated. The modified lock 216 thus would allow the cabinet to be locked while a drawer was still open, and as soon as the open drawer was closed, it would immediately lock. Thereafter, no drawers could be opened until the lock was deactivated. The biasing force exerted on reciprocating member 224 in modified lock 216 should be sufficient to remove the slack in cable 74 when all the drawers are closed and to maintain the cable in the locked, low slack condition when pulling forces are exerted against one or more locked drawers.

Lock 216 may be further modified to include a solenoid, or other electrically controlled switch, that controls the movement of reciprocating member 224 between its locked and unlocked position. The solenoid could be controlled remotely by a user using a hand-held device that transmitted wireless signals to a receiver in the cabinet that controlled the solenoid. The control could be carried out in a conventional manner, such as in the manner in which remote, keyless entry systems work on many current automobiles. Alternately, the cabinet could include a keypad, or other input device, in which the locking or unlocking of the cabinet was controlled by information, such as a code or password, input by a user.

A single interlock 72' is all that is needed for each drawer in the cabinet. The opposite drawer slide can thus be a regular drawer slide with no interlock attached. Interlock 72, of course, can be attached directly to the cabinet, rather than integrated with the drawer slide. During the installation of the interlock system into a cabinet, the slack in the cable maybe easily set by securing one end of the cable, opening a single drawer, and then pulling the cable until substantially all of its slack is removed. The cable is then secured in that condition. When the drawer is thereafter closed, the cable will have sufficient slack to allow only a single drawer to be opened at a time. Alternatively, cables 74 could be manufactured at a preset length to fit different cabinet heights. The installer of the interlocks therefore could simply fasten the cable in the desired location and the length of the cable will create the appropriate slack to allow a single drawer to be opened. Once the appropriate length of a cable is determined for a given cabinet height, cables could be easily mass-produced by a manufacturer by simply cutting them to the appropriate lengths.

Figure 56:
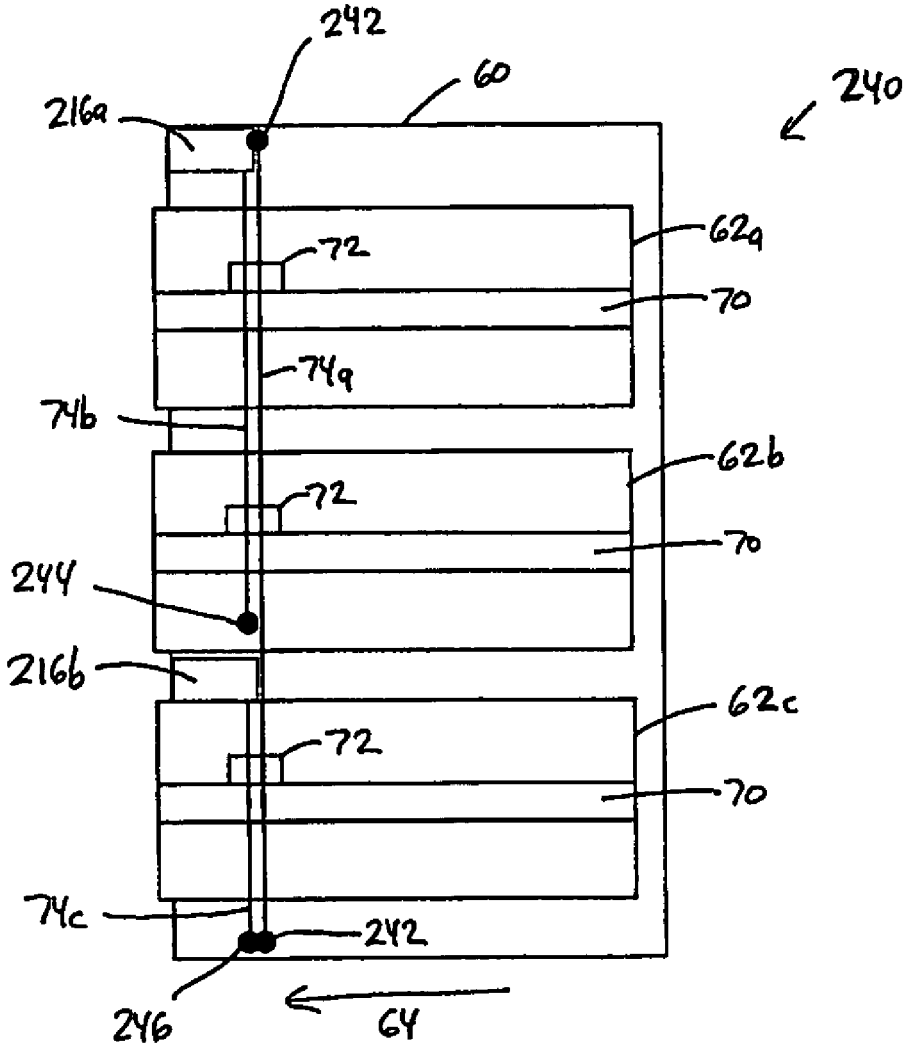
FIG. 56 is a side, sectional view of a cabinet and interlock system according to one aspect of the present invention.
Figure 57:
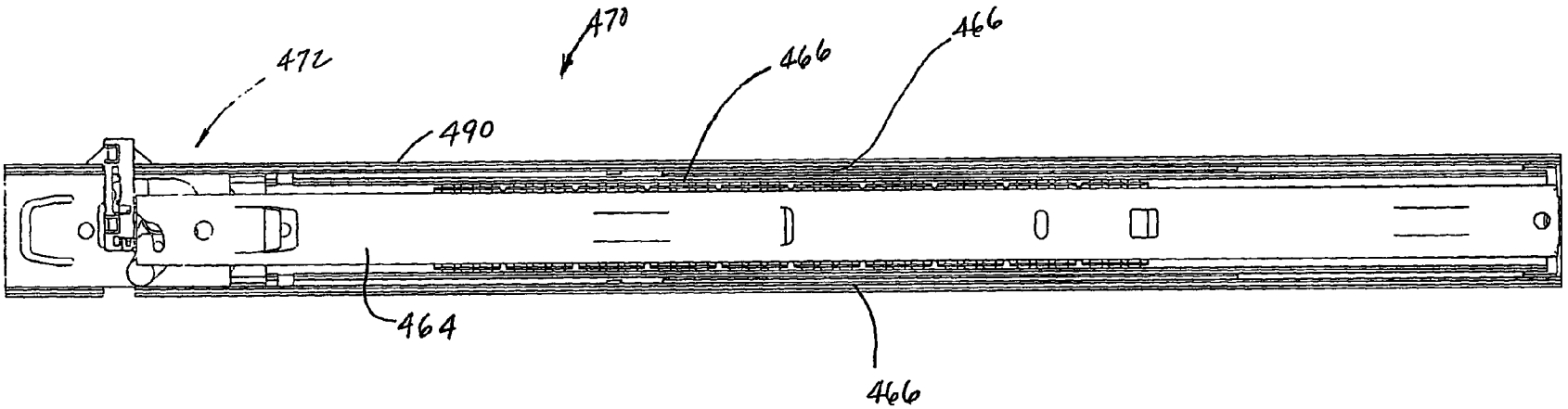
FIG. 57 is a side, elevational view of a drawer slide and interlock according to another embodiment of the present invention.

An interlock system 240 is depicted in FIG. 56. Interlock system 240 is depicted on cabinet 60, which includes three drawers 62*a*-62*c*. Interlock system 240 includes three interlocks 72. It should be understood that interlocks 72 may be replaced with interlocks 72' (or interlocks 472 described below). An upper lock 216*a* and a lower lock 216*b* are included. Upper lock 216*a* is adapted to selectively lock the uppermost two drawers 62*a* and 62*b*. Lower lock 216*b* is adapted to selectively lock the lower drawer 62*c*. An interlock cable 74*a* extends vertically within cabinet 60 and runs through each of the interlocks 72 for each of the drawers 62*a-c*. Cable 74*a* is attached within the cabinet at attachment points 242, which may utilize J-hooks 300, or any other suitable means, for attaching cable 74*a* within cabinet 60. These alternative means may include a screw, a bolt, or other means. An upper cable 74*b* runs vertically from upper lock 216*a* through the two interlocks 72 of the uppermost two drawers 62*a* and *b*. The lower end of upper cable 74*b* is secured at an attachment point 244, which may be positioned above lowermost drawer 262*c*. Alternatively, attachment point 244 may be positioned below drawer 62*c*, but cable 74*b* should not run through interlock 72 of lowermost drawer 62*c*. Lower cable 74*c* extends vertically from lower lock 216*b* to the bottom of cabinet 60. Lower cable 74*c* is secured to the bottom of cabinet 60 at an attachment point 74*c*. The interlock 72 of upper drawer 62*a* and *b* thus have two cables 74*a* and *b* passing through them. Cable 74*a* and *b* may be threaded through interlock 72 in the same manner as has been described previously. Specifically, both cables 74*a* and *b* may be threaded through cable guides 84 and around engagement lug 104.

When either cable 74*a* or 74*b* is in the low slack condition, interlock 72 will prevent the associated drawers 62*a* or *b* from being opened. If both cables 74*a* and *b* are in the low slack condition, interlock 72 will also, of course, prevent the associated drawers 62*a* or *b* from being opened. Because cable 72*a* also runs through the interlock associated with the lowermost drawer 62*c*, only one drawer in the entire cabinet may be opened at a given time. Cable 74*c*, which runs through the interlock 72 of the lowermost drawer 62*c*, allows the lowermost drawer 62*e* to be selectively locked independently of the locking of the uppermost two drawers 62*a* and *b*. Cables 74*a* and *c*, which run through interlock 72 of the lowermost drawer 62*c*, may be run side by side through interlock 72 in the same manner that has been described above. Alternatively, an additional engagement lug 104 may be provided on all of the interlocks that extends outwardly in an opposite direction to engagement lug 104. Cable guide 84 may be modified to include a second channel to accommodate the second cable and align it with the added engagement lug. Other modifications may be made to accommodate the second cable. System 240 allows the two upper drawers to be locked independently of the lower-most drawer while only a single drawer may be opened at any time if either or both of the locks are not activated.

An interlock 472 according to yet another embodiment of the present invention is depicted in FIGS. 57-61. Though many parts of interlock 472 are similar to the previous embodiments, the numbers have been changed for clarity, except for cable 74. Interlock 472 is attached to a drawer slide 470 and operatively coupled to a cable 74 (FIGS. 59-61) that runs vertically inside of the cabinet. In general, similar to previous embodiments, interlock 472 operates according to the amount of slack in cable 74. When no drawers are opened and the lock is not activated, cable 74 has a high amount of stack in it. When a single drawer is opened, interlock 472 takes up most or all of the slack in cable 74 and creates a second, lower level of slack in cable 74. The lower level of slack in cable 74 is such that no other drawers in the cabinet can be opened. This lower level of slack may be zero, or may include a small amount of slack. When the open drawer is closed, more slack in the cable 74 returns and any other single drawer may thereafter be opened. If a lock is included with the cabinet, the lock is adapted to alter the slack in cable 74. When in the locked position, the lock removes most or all of the slack in cable 74. When in the unlocked condition, the lock allows cable 74 to have sufficient slack so that a single drawer may be opened. Interlocks 472 are thus designed to only allow their associated or attached drawer to be opened when cable 74 has sufficient slack. Further, they are designed to remove substantially all of the slack in cable 74, if their associated drawer is opened. The detailed construction of interlock 472 will now be described below. For details of suitable locks, reference is made to the description provided above.

Interlock 472 is adapted to be attached directly to a drawer slide 470. While interlock 472 is depicted attached to the back end of the drawer slide, it will be appreciated that it can be attached to a drawer slide at any desirable location along the drawer slide's length. Alternately, the interlock can be attached directly to the cabinet. Interlock 472 operates in conjunction with cable 74 so that only a single drawer can be open at a given time. As understood from FIGS. 59-61, interlock 472 is attached to stationary portion 490 of drawer slide 470. Stationary portion 490 is fixedly secured to the interior of the cabinet. Stationary portion 490 includes a first aperture 450 and a second aperture 452 (FIG. 61). Aperture 450 receives a first rivet 454 that pivotally secures a lever 456 to stationary portion 490. Aperture 452 receives a second rivet 458 that pivotally secures a cam 460 to stationary portion 490. Interlock 472 further includes a cable guide 484, which is similar to cable guide 84' described in reference to the previous embodiment. Therefore for further details for cable guide reference is made to previous embodiments. Guide 484 is mounted to a flange (not shown) on stationary portion 490 in generally the same manner that cable guide 84 is mounted to attachment plate 76 of interlock 72. Interlock 472 further includes a spring 462 (shown in phantom in FIG. 61) and an engagement member 486.

Figure 58:
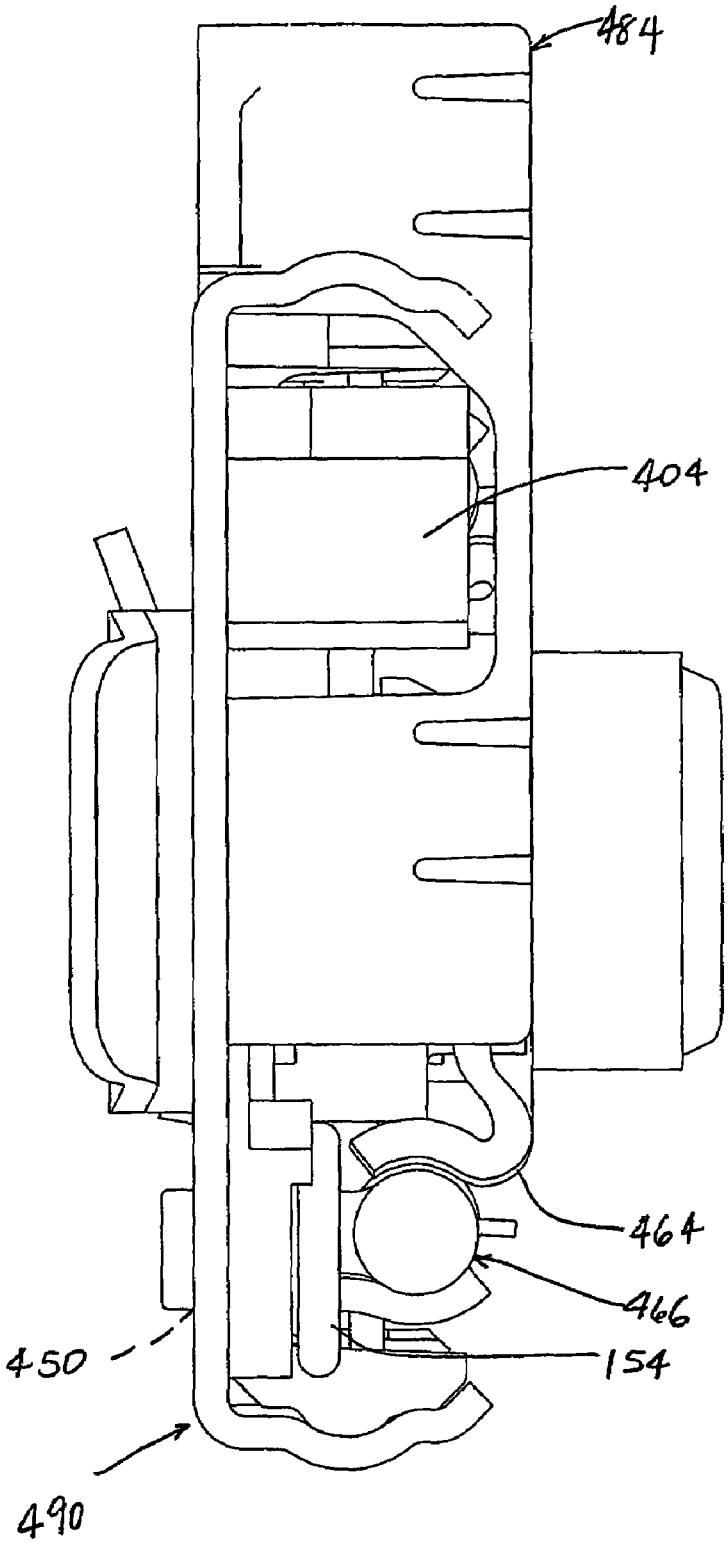
FIG. 58 is an enlarged end view of the drawer slide and interlock of FIG. 57.
Figure 59:
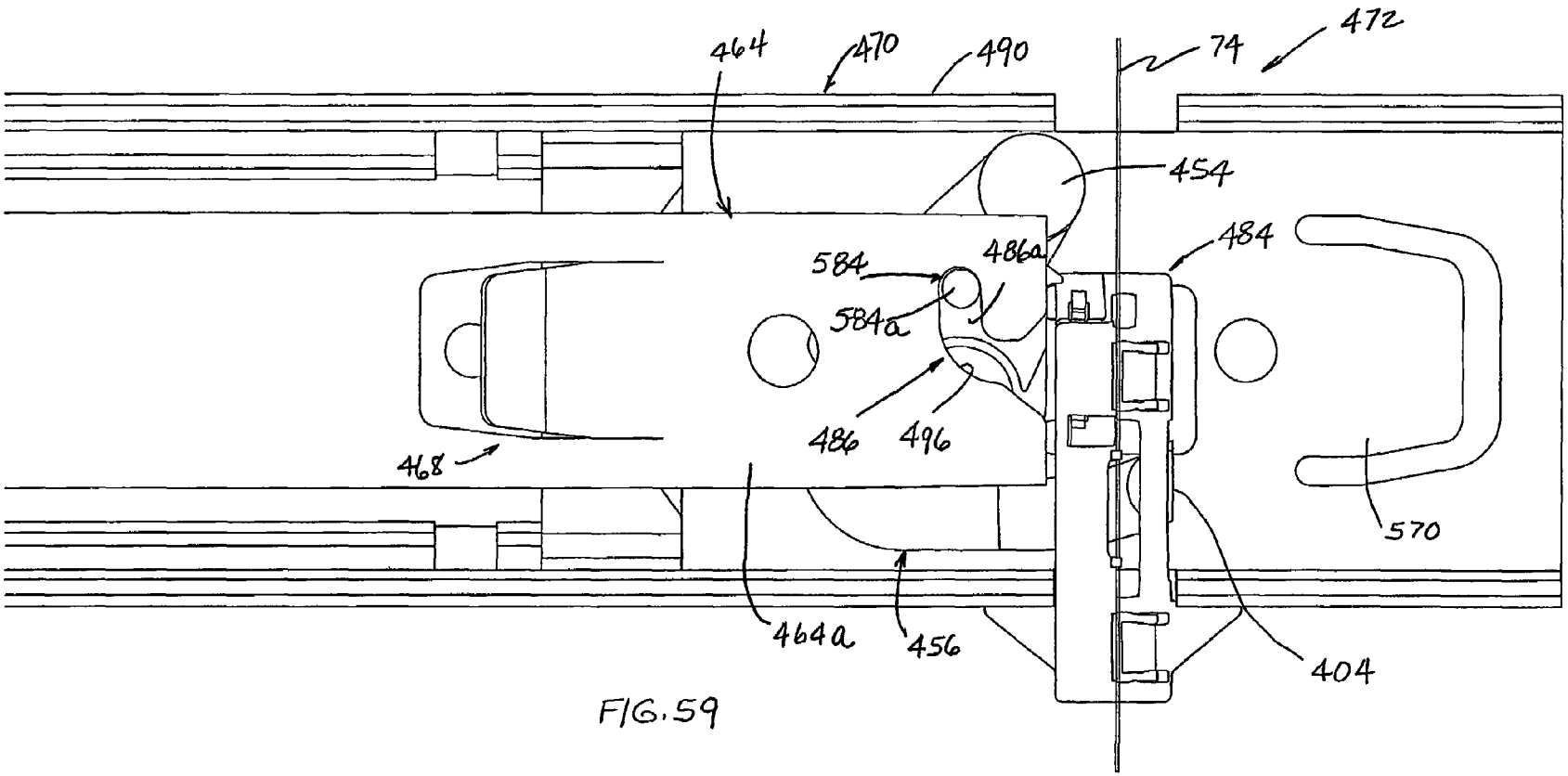
FIG. 59 is an enlarged view of the drawer slide and interlock of FIG. 57 illustrating the interlock in a locked position.
Figure 60:
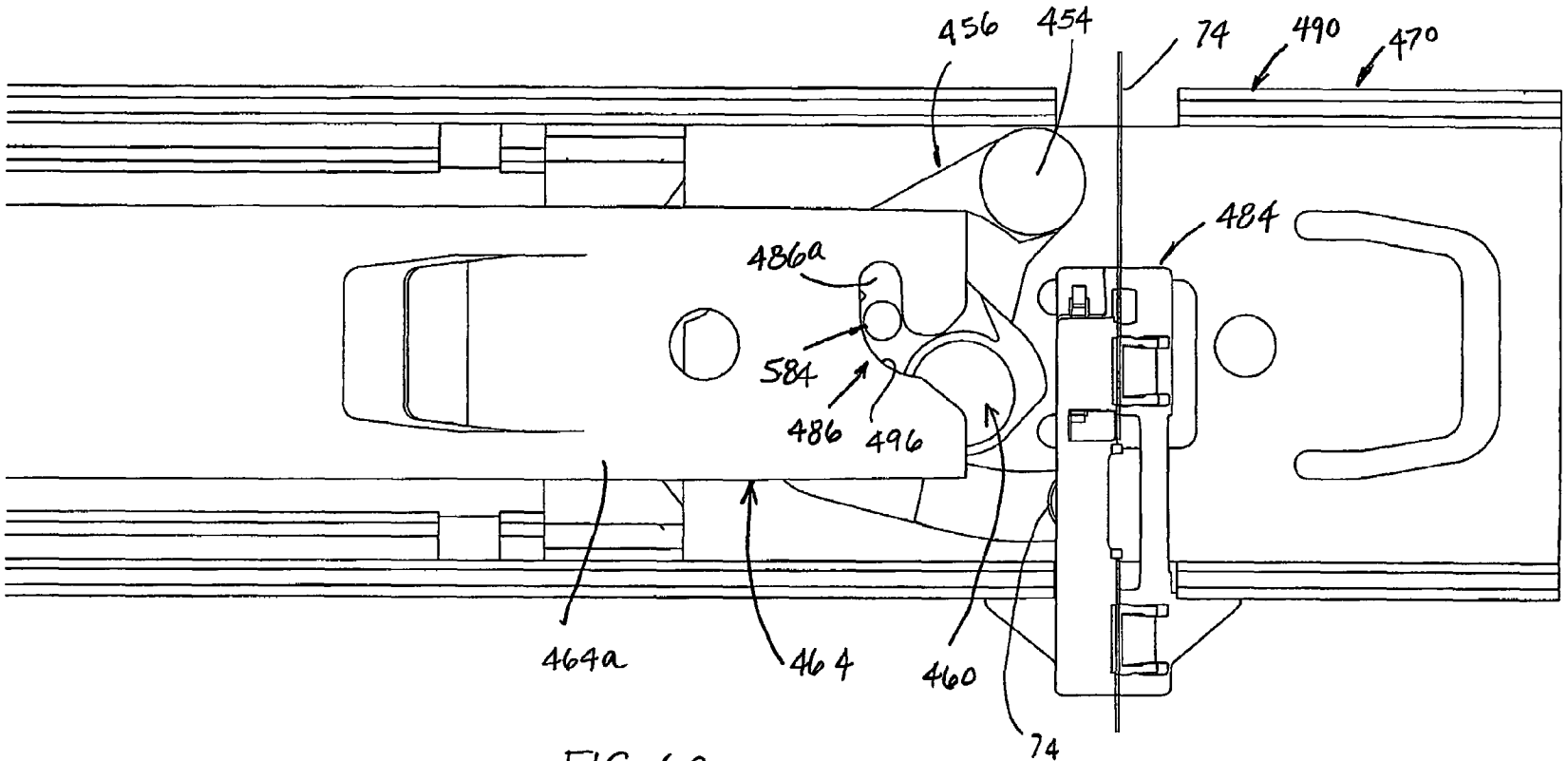
FIG. 60 is an enlarged view of the drawer slide and interlock of FIG. 57 illustrating the interlock in an unlocked position with the engagement member in contact with the cam.
Figure 61:
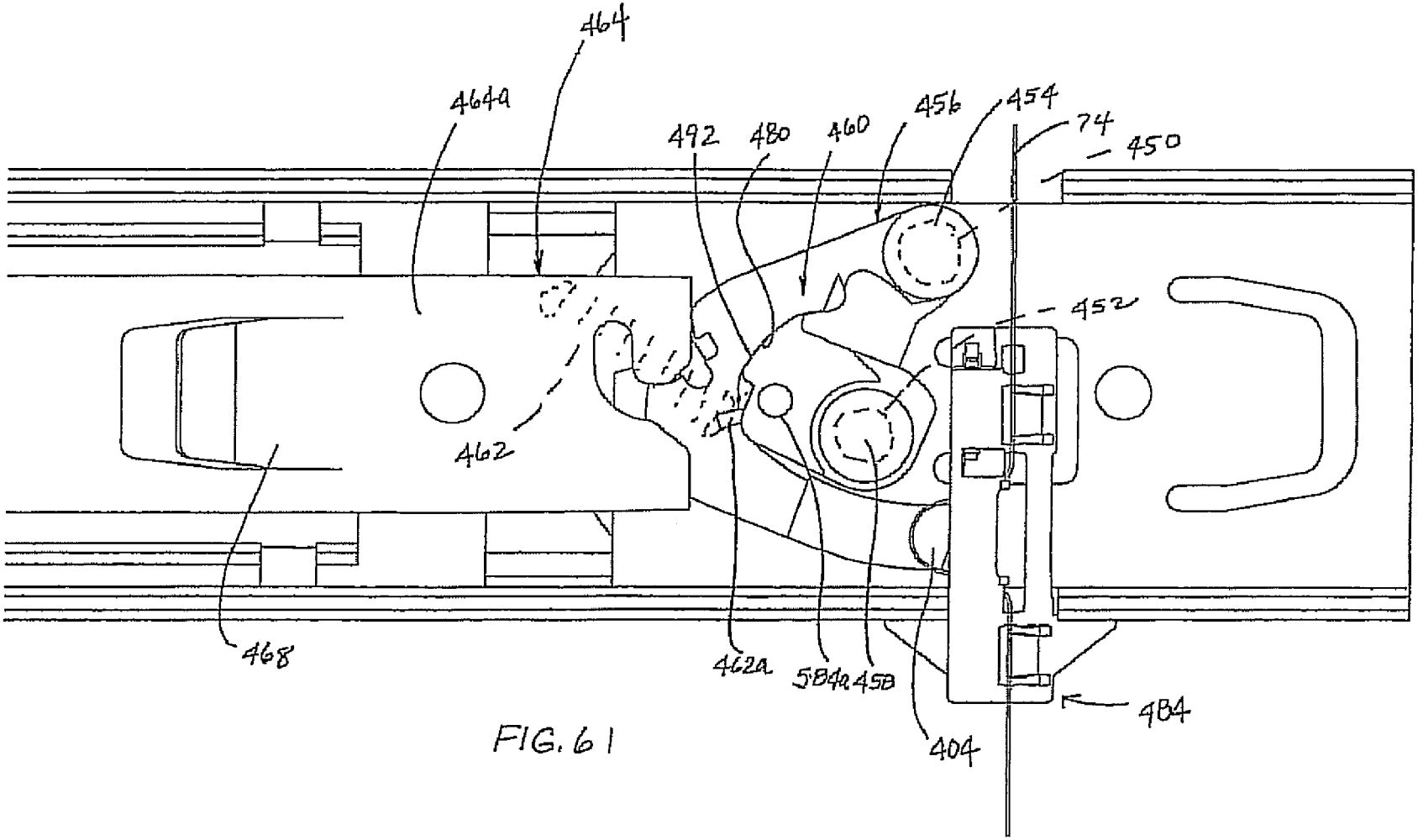
FIG. 61 is an enlarged view of the drawer slide and interlock of FIG. 57 illustrating the interlock in an unlocked position in which the engagement member of the slide has moved out of engagement of the cam.

Spring 462 mounts on one end to the lever 456 at a stop 462*a* and on its other end to fixed rail 490 in a manner to urge lever 456 to move in a counter-clockwise direction about rivet 454 (as viewed in FIGS. 59-61). However, when, as will be more fully described below, the drawer is extended from the cabinet, lever 454 will compress spring 462 under the influence of cam 460 and will pull on cable 74 so that cable 74 is in a low slack condition (FIG. 61). In the illustrated embodiment, engagement member 486 comprises an elongate aperture or slot 486*a* formed in the web 464*a* of slidable portion 464 of drawer slide 470. Slidable portion 464 is slidable with respect to stationary portion 490 by way of a plurality of bearings 466, such as ball bearing cages that house a plurality of ball bearings, which are in contact with both slidable portion 464 and stationary portion 490 of drawer slide 470 (FIG. 58). Slidable portion 464 is adapted to be secured to a drawer. Slidable portion 464 may include one or more attachment flanges 468 for releasably securing slidable portion 464 to the drawer. Similarly, stationary portion 490 may also include one or more attachment flanges 570 used to releasably secure stationary portion 490 to the interior of the cabinet.

Lever 456 is pivotable about a pivot axis generally defined by first rivet 454. Lever 456 includes an aperture for receiving first rivet 454, similar to the previous embodiments. As noted above, lever 456 includes a spring attachment tab or nub 462*a* to which one end of the spring is secured and an engagement lug 404 that engages cable 74. When lever 456 rotates about its pivot axis in a clockwise direction (as viewed in FIGS. 59-61), engagement lug 404 pulls against cable 74 decreasing the slack in cable 74. Spring 462 exerts a force on lever 456 that tends to resist this rotation and is compressed when lever 456 rotates to pull on cable 74.

Similar to the previous embodiments, lever 456 includes an inner surface portion 480, which optionally defines the range of motion of cam 460. When a drawer is initially opened, cam 460 rotates counterclockwise and exerts a rotational force on lever 456. If cable 74 is not in a low slack condition, surface portion 492 of cam 460 pushes against inner surface portion 480 until lever 456 is rotated sufficiently to remove the slack.

Cam 460 is rotationally secured to stationary portion 490 of drawer slide 470 by way of second rivet 458. Cam 460 includes an engagement surface 584, such as a pin 584*a*, with which engagement member 486 is engaged when the associated drawer is in the closed position. Pin 584*a* contacts engagement member 486 when the associated drawer is pulled in an extended or first direction. When a drawer is pulled in the extended direction, engagement member 486 engages pin 584*a* and imparts a rotational force on cam 460. The shape of aperture 486*a* is such that as the drawer is extended, pin 584*a* is urged downward (as viewed in FIG. 60) to pivot cam 460 in a counterclockwise direction (as viewed in FIG. 60). The rotation of cam 460 in this direction causes a surface portion 492 of cam 460 (FIG. 61) to rotate lever 456 in a counterclockwise direction and, thereby, compress spring 462.

This rotation of lever 456 takes up any slack in cable 74 by way of engagement lug 404. However, if cable 74 is already in a low slack condition, lever 456 will be prevented from rotating sufficiently so that full rotation of cam 460 will therefore be prevented. Engagement member 486 of slidable portion 464 of drawer slide 470 wilt therefore not be able to disengage from pin 584*a* of cam 460. Drawer slide 470 will therefore not be able to slide, and the attached drawer will not be able to open.

When cable 74 is changed to the low slack condition by another interlock or lock, cam 460 cannot rotate further. If cable 74 is not already in a low slack condition, then cam 460 will be able to rotate sufficiently to allow engagement member 486 to disengage from pin 584*a*. Slide 470 is therefore free to slide and the attached drawer can be fully opened. When the drawer is fully open, the spring 462 exerts a force on lever 456 in a direction opposite its clockwise rotational direction, which tends to maintain the surface portion 492 of cam 460 in frictional contact with inner surface portion 480 of lever 456. This maintains cam 460 in the proper rotational attitude for pin 584*a* to be engaged by engagement member 486. When the drawer is being closed, engagement member 486 comes into contact with pin 584*a* on cam 460. As the drawer is fully closed, engagement member 486 pushes against pin 584*a* to thereby cause cam 460 to rotate in a clockwise direction (as viewed from FIG. 60 to FIG. 59). This rotation causes surface portion 492 of cam 460 to move along inner surface portion 480. This, in turn, allows lever 456 to rotate in a counterclockwise direction (as viewed in FIGS. 60 and 61). This rotation causes engagement lug 404 to decrease the force on cable 74. The closing of the drawer therefore decreases any tension in cable 74 and increases its slack.

In addition to maintaining cam 460 in its proper rotational orientation when a drawer is opened, spring 462 helps prevent the drawers from rebounding open, or partially open, after they are slammed shut. Without the spring, it might be possible for a drawer to be slammed shut with sufficient force such that the rebound of the drawer might rotate the cam and allow the drawer to open up again. The spring helps prevent such rebounding of the drawers into the open position by biasing the lever in a direction that resists the rotation of the cam, as noted in reference to the previous embodiment.

Referring to FIGS. 59-61, engagement member 486 includes a sloped surface 496 that helps ensure that pin 584*a* is successfully guided back into recess 586*a* when a drawer is closed. If pin 584*a* contacts sloped surface 496, it will exert a rotational force on cam 460 that tends to rotate cam 460 so that pin 584*a* is properly aligned to extend into recess 486*a*. For further details of lever 456 and the interaction with cam 460, reference is made to the lever and cam of interlock 72'.

FIGS. 59-61 depict interlock 472 in several different states. In FIG. 59, interlock 472 is in the position it would be if the drawer is closed. FIG. 60 illustrates the interlock if someone were pulling on the attached drawer while the cable 74 (not shown) was in a high slack condition when engagement member 486 has just begun to disengage from pin 584*a*. FIG. 61 depicts an interlock 472 in which the drawer has opened sufficiently far to disengage engagement member 486 from pin 584*a*.

While other materials may be used, the interlocks described herein may be made primarily of metal. Specifically, the attachment plates, sliding plates, cams, and rivets may all be made of metal, such as steel, or any other suitable metal. The engagement members may be made of metal or any other suitable material. The cable guides may be all made from plastic. The drawer slides are preferably made of metal, such as steel, with the exception of the ball bearing cages for the ball bearings, which may be made of plastic. The levers, cams, and cable guides of interlock 72' or interlock 472 may all be made of plastic. The first and second rivets, stationary portion, and slidable portion may also all be made of metal, such as steel. Spring 82 of interlock 72 may exert a force of 1.5 pounds. The springs of interlock 72' and 472 may exert a force of approximately 0.5 pounds. Other spring strengths may, of course, be used. The cables may comprise steel cables each composed of seven strands, with each strand made of seven individual filaments and may have a tensile strength of 40 pounds. The cables may preferably be made of stainless steel and include a vinyl coating. For example, the diameter of the cable after coating may be 0.024 inches, although other dimensions can be used. To avoid kinking of the cables, surfaces that come in contact with the cable, such as the engagement lug, may be curved with a radius of at least 0.125 inches to help reduce the possibility of kinking. As several possible alternatives to steel, the cable could be a string, a plastic based line, such as those used as fishing lines, or any other elongated, flexible member with suitable tensile strength.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the following claims.

What is claimed is:

1. An interlock for a drawer positionable within a cabinet, the drawer being movable in the cabinet in a first direction toward an open position and in a second, opposite direction toward a closed position, said interlock comprising:

an elongated, flexible member;

a rotatable lever adapted to switch the amount of slack in said elongated, flexible member between a low slack condition and a high slack condition by rotating between a first and second position, respectively;

a rotatable engagement member that is rotatable relative to the rotatable lever and is positioned to cause said rotatable lever to rotate toward said first position when said drawer is initially moved from the closed position in the first direction.

2. The interlock of claim 1 further comprising a biasing member positioned adjacent said lever, said biasing member adapted to exert a biasing force that tends to prevent said lever from rotating from said second position to said first position until said drawer is moved in said first direction to the open position.

3. The interlock of claim 1 wherein said elongated, flexible member is a cable.

4. The interlock of claim 3 further including a cable guide adapted to snap-fittingly receive the cable from at least one direction.

5. The interlock of claim 1 wherein said elongated, flexible member is in communication with at least one other rotatable lever associated with another drawer, said at least one other rotatable lever adapted to change said elongated, flexible member from the high slack to the low slack condition when the at least one other drawer is moved to an open position.

6. The interlock of claim 1 wherein said elongated, flexible member is in communication with a lock, said lock adapted to selectively change said elongated, flexible member between said low and high slack conditions.

7. The interlock of claim 6 further including a second, elongated flexible member in communication with a second lock and said lever, said second lock adapted to selectively change said second elongated, flexible member between said low and high slack conditions.

8. The interlock of claim 1 wherein said lever is to be mounted on a drawer slide member.

9. The interlock of claim 8 wherein said interlock is to be solely mounted to said drawer slide member.

10. The interlock of claim 1 wherein said rotatable lever is configured to translate a first force exerted on the drawer in the first direction into a second force exerted against said elongated, flexible member that is less than said first force.

11. The interlock of claim 10 wherein said second force is less than one-half of said first force.

12. An interlock for a drawer positionable within a cabinet, the drawer being movable in the cabinet in a first direction toward an open position and in a second, opposite direction toward a closed position, said interlock comprising:

an elongated, flexible member adapted to be changeable between a high slack condition and a low slack condition;

a cam member having a driving surface, and having a projection that communicates with a slot in a drawer slide member;

an actuating member positioned to be operatively engageable with said elongated, flexible member, and engageable with the cam driving surface, said actuating member adapted to change said elongated, flexible member to said low slack position when the drawer is opened and to allow said elongated flexible member to exist in said high slack condition when the drawer is closed; and wherein the actuating member moves via the cam drive surface with the cam being moved via the projection being engaged with the slot in the drawer slide member.

13. The interlock of claim 12 wherein the actuating member further comprises a rotatable lever.

14. The interlock of claim 12 wherein the cam member is rotatable.

15. The interlock of claim 12 further comprising a spring that exerts a force on said actuating member.

16. The interlock of claim 12 wherein the actuating member is adapted to move a distance with respect to the elongated, flexible member at least five times greater than the distance the drawer moves when initially being moved toward an open position.

17. The interlock of claim 12 wherein the cam member is to be mounted on a drawer slide member.

18. The interlock of claim 12 wherein the interlock is to be mounted on a drawer slide.

19. The interlock of claim 12 wherein the actuating member is adapted to move with respect to the elongated, flexible member faster than the driving surface moves when the drawer is initially being moved toward an open position.

20. An interlock for a drawer positionable within a cabinet, the drawer being movable in the cabinet in a first direction toward an open position and in a second, opposite direction toward a closed position, said interlock comprising:

an elongated, flexible member;

a rotatable lever adapted to switch the amount of slack in said elongated, flexible member between a low slack condition and a high slack condition by rotating between a first and second position, respectively;

an engagement member positioned to cause said rotatable lever to rotate toward said first position when said drawer is initially moved from the closed position in the first direction;

wherein said engagement member further comprises a projection that communicates with a slot in a drawer slide member; and wherein the rotatable lever moves via the engagement member with the engagement member being moved via the projection being engaged with the slot in the drawer slide member.

21. The interlock of claim 20 wherein said interlock is to be solely mounted to a drawer slide having said drawer slide member.

* * * * *